US010358803B2

(12) United States Patent
Nagata et al.

(10) Patent No.: US 10,358,803 B2
(45) Date of Patent: Jul. 23, 2019

(54) SPOUT APPARATUS

(71) Applicant: TOTO LTD., Kitakyushu-shi, Fukuoka (JP)

(72) Inventors: Katsuya Nagata, Kitakyushu (JP); Kiyotake Ukigai, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/714,863

(22) Filed: Sep. 25, 2017

(65) Prior Publication Data

US 2018/0094414 A1 Apr. 5, 2018

(30) Foreign Application Priority Data

Sep. 30, 2016 (JP) ..... 2016-193287
Jul. 7, 2017 (JP) ..... 2017-133792

(51) Int. Cl.
*E03C 1/086* (2006.01)
*B05B 1/18* (2006.01)
*E03C 1/08* (2006.01)

(52) U.S. Cl.
CPC ..... *E03C 1/086* (2013.01); *B05B 1/185* (2013.01); *E03C 1/08* (2013.01)

(58) Field of Classification Search
CPC . E03C 1/086; E03C 1/08; E03C 1/084; B05B 1/185; B05B 1/14; B05B 1/34; B05B 15/40

(Continued)

(56) References Cited

U.S. PATENT DOCUMENTS 8,308,079 B2 * 11/2012 Grether ..... E03C 1/084 239/111
2011/0240767 A1 * 10/2011 Kitaura ..... E03C 1/084 239/428.5

(Continued)

FOREIGN PATENT DOCUMENTS

CN 201933557 U 8/2011
DE 202010003997 U1 9/2011

OTHER PUBLICATIONS

Extended European Search Report for EP 17193772.5 dated Mar. 21, 2018.

*Primary Examiner* — Arthur O. Hall
*Assistant Examiner* — Juan C Barrera
(74) *Attorney, Agent, or Firm* — Baker & Hostetler LLP

(57) ABSTRACT

The present invention is a spout apparatus including: a spout forming member configured to form a spout; a flow-guiding member provided inside the spout forming member, configured to guide water on an upstream side of the spout; an exposed flow-guiding member provided inside the spout forming member and on a spout side of the flow-guiding member, and exposed on a spout side of the exposed flow-guiding member; and a water channel configured to supply the water to an upstream side of the flow-guiding member. The exposed flow-guiding member and/or the spout forming member are configured to spout water from an outer periphery as an annular stream, among the water spouted from the spout. According to the above spout apparatus, the flow-guiding member can be effectively protected, and high guiding characteristics can be achieved in particular at an outer periphery of the spout.

16 Claims, 21 Drawing Sheets

(58) Field of Classification Search
USPC ..... 239/553, 553.3, 553.5
See application file for complete search history.

(56) References Cited

U.S. PATENT DOCUMENTS

| | | | | |
|---|---|---|---|---|
| 2012/0018661 | A1 | 1/2012 | Kao et al. | |
| 2013/0008980 | A1 | 1/2013 | Grether | |
| 2015/0204058 | A1 * | 7/2015 | Grether | E03C 1/084 239/428.5 |

* cited by examiner

SPOUT APPARATUS

TECHNICAL FIELD

The present invention pertains to a spout apparatus that can be used for an overhead shower.

BACKGROUND ART

The applicant has already proposed a spout apparatus configured to guide water by providing a flow-flow-guiding member (for example, a mesh member) therein in order to reduce water splash, that may be caused when the spouted water lands on a human body, and/or in order to make the spouted water look beautiful (Please see JP-A-2016-75081).

In the spout apparatus described in the JP patent document, a distance for which the shape of the spouted water as one linear stream is continued can be maximized. For example, a water stream from the spout apparatus installed on a ceiling in a bath room can reach a user's head and/or shoulder(s) or a floor in the bath room, without any split of the spouted water, even when the amount of the spouted water is small. When such a water stream lands on the human body, the water stream can form a water film along the human body, which can envelop the entire human body. Thus, if the water stream consists of a hot water stream, a deep body temperature of the human body can be effectively increased.

PATENT DOCUMENT LIST

JP-A-2016-75081

SUMMARY OF INVENTION

Technical Problem

As described above, JP-A-2016-75081 has already proposed a spout apparatus which is effective particularly when adopted for an overhead shower. However, there is a concern that calcium might be precipitated on the flow-flow-guiding member (for example, a mesh member). When calcium is precipitated on the flow-flow-guiding member, the spouted water may be disturbed, so that guiding characteristics thereof may be remarkably deteriorated.

Therefore, if calcium is precipitated on the flow-flow-guiding member, it is necessary to carry out a maintenance operation for the flow-flow-guiding member in order to remove the precipitated calcium. However, in order to carry out the maintenance operation in the case of the conventional structure, it was necessary to break down a spout portion and remove out the flow-flow-guiding member. That is to say, it was very difficult to carry out the maintenance operation.

The inventors have studied for forming an exposed member (portion) at a spout by means of an elastic member, as a structure promoting the maintenance operation. In detail, the inventors have studied for providing an exposed flow-flow-guiding member consisting of an elastic member on a spout side of a conventional flow-flow-guiding member. Such an exposed flow-flow-guiding member can be manually pressed and deformed by a user, so that calcium precipitated thereon can be easily removed.

However, when an exposed flow-guiding member consisting of an elastic member is provided on a spout side of a conventional flow-guiding member, the exposed flow-guiding member has to have a certain amount of thickness in view of a strength thereof as well as in view of reasons on manufacturing thereof. The inventors have found that a split of the spouted water may be caused at a downstream end of the exposed flow-guiding member having such a thickness (see FIGS. 25A and 25B).

In particular when the amount of the spouted water is large, the split of the spouted water is easily caused at an outer periphery of a spout. The guiding characteristics at the outer periphery of the spout have a great effect on the guiding characteristics for the entire spouted water. Thus, it is strongly desired to avoid such a split of the spouted water.

The present invention has been made based on the above findings. The object of the present invention is to provide a spout apparatus whose maintenance operation can be easily carried out and which can achieve high guiding characteristics in particular at an outer periphery of a spout.

In addition, the inventors have found that, if the flow-guiding member is an easily deformable (delicate) member, when a foreign body contacts with the flow-guiding member or a user wrongly presses the flow-guiding member, the flow-guiding member may be adversely deformed so that the guiding characteristics thereof may be deteriorated. Furthermore, the inventors have found that, when an exposed member (portion) at a spout is formed by an exposed flow-guiding member separate (different) from the flow-guiding member, the flow-guiding member can be effectively protected from the contact of the foreign body or the like. This effect can be obtained even if the separate exposed flow-guiding member is not an elastic member.

However, when another exposed flow-guiding member is provided on a spout side of a conventional flow-guiding member, the exposed flow-guiding member has to have a certain amount of thickness in view of a strength thereof as well as in view of reasons on manufacturing thereof. The inventors have found that a split of the spouted water may be caused at a downstream end of the exposed flow-guiding member having such a thickness (see FIGS. 25A and 25B).

In particular when the amount of the spouted water is large, the split of the spouted water is easily caused at an outer periphery of a spout. The guiding characteristics at the outer periphery of the spout have a great effect on the guiding characteristics for the entire spouted water. Thus, it is strongly desired to avoid such a split of the spouted water.

The present invention has been made based on the above findings. The object of the present invention is to provide a spout apparatus whose flow-guiding member can be effectively protected and which can achieve high guiding characteristics in particular at an outer periphery of a spout.

Solution to Problem

The present invention is a spout apparatus including: a spout forming member configured to form a spout; a flow-guiding member provided inside the spout forming member, configured to guide water on an upstream side of the spout; an exposed flow-guiding member provided inside the spout forming member and on a spout side of the flow-guiding member, and exposed on a spout side of the exposed flow-guiding member; and a water channel configured to supply the water to an upstream side of the flow-guiding member; wherein the exposed flow-guiding member and/or the spout forming member are configured to spout water from an outer periphery as an annular stream, among the water spouted from the spout.

According to the above feature, since the water located at the outer periphery among the water spouted from the spout is spouted as an annular stream, the water can be spouted at the outer periphery while achieving high guiding characteristics. Therefore, even if the guiding characteristics at a central portion of the spout are deteriorated due to the separate exposed flow-guiding member provided on the spout side of the flow-guiding member, generation of a split of the spouted water can be remarkably prohibited, so that extremely high guiding characteristics can be achieved.

In one specified manner, a spout apparatus includes: a spout forming member configured to form a spout; a flow-guiding member provided inside the spout forming member, configured to guide water on an upstream side of the spout; an exposed flow-guiding member provided inside the spout forming member and on a spout side of the flow-guiding member, and exposed on a spout side of the exposed flow-guiding member; and a water channel configured to supply the water to an upstream side of the flow-guiding member; wherein the exposed flow-guiding member is made of an elastic member, the exposed flow-guiding member has an outer-periphery guiding surface at an area on the spout side of the exposed flow-guiding member, the outer-periphery guiding surface has an annular shape, and an annular guiding space is formed between the outer-periphery guiding surface and the spout forming member.

According to the specified manner, the exposed flow-guiding member made of an elastic member has the outer-periphery guiding surface at the area on the spout side of the exposed flow-guiding member, the outer-periphery guiding surface has the annular shape, and the annular guiding space is formed between the outer-periphery guiding surface and the spout forming member. Therefore, the water can be spouted at the outer periphery of the spout while achieving high guiding characteristics. That is to say, even if the guiding characteristics at a central portion of the spout are deteriorated due to the separate exposed flow-guiding member made of an elastic member provided on the spout side of the flow-guiding member for improving maintenance characteristics, generation of a split of the spouted water can be remarkably prohibited, so that extremely high guiding characteristics can be achieved. That is to say, both of the improved maintenance characteristics and the high guiding characteristics can be achieved.

In addition, since the exposed flow-guiding member is made of an elastic member, the exposed flow-guiding member can be manually pressed and deformed by a user, so that calcium precipitated thereon can be easily removed therefrom. That is to say, the maintenance operation can be easily carried out.

In another specified manner, a spout apparatus includes: a spout forming member configured to form a spout; a flow-guiding member provided inside the spout forming member, configured to guide water on an upstream side of the spout; an exposed flow-guiding member provided inside the spout forming member and on a spout side of the flow-guiding member, and exposed on a spout side of the exposed flow-guiding member; and a water channel configured to supply the water to an upstream side of the flow-guiding member; wherein the exposed flow-guiding member has an outer-periphery guiding surface at an area on the spout side of the exposed flow-guiding member, the outer-periphery guiding surface has an annular shape, and an annular guiding space is formed between the outer-periphery guiding surface and the spout forming member.

According to the specified manner, the exposed flow-guiding member has the outer-periphery guiding surface at the area on the spout side of the exposed flow-guiding member, the outer-periphery guiding surface has the annular shape, and the annular guiding space is formed between the outer-periphery guiding surface and the spout forming member. Therefore, the water can be spouted at the outer periphery of the spout while achieving high guiding characteristics. That is to say, even if the guiding characteristics at a central portion of the spout are deteriorated due to the separate exposed flow-guiding member provided on the spout side of the flow-guiding member for protecting the flow-guiding member, generation of a split of the spouted water can be remarkably prohibited, so that extremely high guiding characteristics can be achieved. That is to say, both of the protecting characteristics for the flow-guiding member and the high guiding characteristics can be achieved.

In each of the above manners, preferably, the annular guiding space has a cylindrical shape, and a length of the annular guiding space in a water-flow direction is greater than a width of the annular guiding space in a radial direction at a downstream end thereof.

When the above conditions are satisfied, even if the water stream contracts after entering the annular guiding space, the water stream is guided by the annular guiding space sufficiently enough to be the annular stream without any split. Thus, the entire guiding characteristics can be maintained.

In addition, preferably, the exposed flow-guiding member has a plurality of tubular hollow spaces that are separated by a baffle extending in a water-flow direction. The plurality of tubular hollow spaces may be circumferentially divided from each of concentric ring (toric) areas in sectional view. In particular, it is preferable that the baffle has a latticed pattern having intersections in plan view. The expression "latticed pattern" in the specification includes not only a manner in which linear lines are intersected with each other, but also a manner in which a linear line and a curve line are intersected with each other and/or a manner in which curve lines (whose curvatures may be different) are intersected with each other. Furthermore, the expression "latticed pattern" in the specification includes not only a manner in which four sides (not limited to linear sections, but including arc sections or the like) define one cell, but also a manner in which three sides or five or more sides define one cell. The manner in which six equal sides define one cell is called a "honeycomb pattern". In addition, the expression "latticed pattern" in the specification also includes a manner in which a shape having no recognizable "side", such as a circle or an oval, defines one cell.

In this case, it is further preferable that a thickness at an outermost and most downstream end of the exposed flow-guiding member is not more than a width of the annular guiding space in a direction of the thickness.

When the above conditions are satisfied, it is possible to maintain a relatively large amount of the water spouted through the annular guiding space, which can achieve a film-like (cylindrical) water stream of the spouted water. The film-like water stream draws the spouted water, so that the entire shape of the water stream spouted from the spout can be maintained. That is to say, the guiding characteristics can be further improved.

In addition, preferably, at least an area on a downstream-end side of an inside surface of the spout has a tapered shape (frusto-conical shape) toward a downstream end of the spout.

In this case, it is possible to effectively reduce the possibility that the split of the spouted water is caused by the thickness at the outermost and most downstream end of the exposed flow-guiding member.

In addition, preferably, the exposed flow-guiding member and the flow-guiding member are provided in contiguity with each other.

In this case, when the exposed flow-guiding member is made of an elastic member, the exposed flow-guiding member can be manually deformed for the maintenance operation thereof, so that the flow-guiding member can be rubbed with the exposed flow-guiding member. Thereby, solid deposit such as calcium precipitated on the flow-guiding member can be removed. That is to say, the maintenance operation for the flow-guiding member can be carried out at the same time.

In addition, preferably, the exposed flow-guiding member is fixed to the spout forming member via a plurality of discrete bridges at an area opposite to the spout, in particular at an end opposite to the spout.

In this case, the annular outer-periphery guiding surface can be effectively formed for providing the annular guiding space together with the spout forming member.

According to the above manner, the exposed flow-guiding member has the outer-periphery guiding surface at the area on the spout side of the exposed flow-guiding member, the outer-periphery guiding surface has the annular shape, and the annular guiding space is formed between the outer-periphery guiding surface and the spout forming member. However, instead of that, the exposed flow-guiding member may have an annular guiding space at an outer peripheral area on the spout side of the exposed flow-guiding member.

According to such a feature as well, since the water located at the outer periphery among the water spouted from the spout is spouted as an annular stream, the water can be spouted at the outer periphery while achieving high guiding characteristics. Therefore, even if the guiding characteristics at a central portion of the spout are deteriorated due to the separate exposed flow-guiding member provided on the spout side of the flow-guiding member, generation of a split of the spouted water can be remarkably prohibited, so that extremely high guiding characteristics can be achieved.

In this manner as well, preferably, the annular guiding space has a cylindrical shape, and a length of the annular guiding space in a water-flow direction is greater than a width of the annular guiding space in a radial direction at a lower end thereof.

When the above conditions are satisfied, even if the water stream contracts after entering the annular guiding space, the water stream is guided by the annular guiding space sufficiently enough to be the annular stream without any split. Thus, the entire guiding characteristics can be maintained.

In addition, preferably, the exposed flow-guiding member has a plurality of tubular hollow spaces that are separated by a baffle extending in a water-flow direction, on an inner side of the annular guiding space. The plurality of tubular hollow spaces may be circumferentially divided from each of concentric ring (toric) areas in sectional view. In particular, it is preferable that the baffle has a latticed pattern having intersections in plan view.

In this case, it is further preferable that a thickness at a most downstream end of a part of the exposed flow-guiding member defining an inner periphery of the annular guiding space is not more than a width of the annular guiding space in a direction of the thickness.

When the above conditions are satisfied, it is possible to maintain a relatively large amount of the water spouted through the annular guiding space, which can achieve a film-like (cylindrical) water stream of the spouted water. The film-like water stream draws the spouted water, so that the entire shape of the water stream spouted from the spout can be maintained. That is to say, the guiding characteristics can be further improved.

In addition, preferably, at least an area on a downstream-end side of the annular guiding space has a tapered shape (frusto-conical shape) toward a downstream end of the annular guiding space.

In this case, it is possible to effectively reduce the possibility that the split of the spouted water is caused by the thickness at the most downstream end of the part of the exposed flow-guiding member defining the inner periphery of the annular guiding space.

In addition, preferably, the exposed flow-guiding member and the flow-guiding member are provided in contiguity with each other.

In this case, when the exposed flow-guiding member is made of an elastic member, the exposed flow-guiding member can be manually deformed for the maintenance operation thereof, so that the flow-guiding member can be rubbed with the exposed flow-guiding member. Thereby, solid deposit such as calcium precipitated on the flow-guiding member can be removed. That is to say, the maintenance operation for the flow-guiding member can be carried out at the same time.

In addition, preferably, a part of the exposed flow-guiding member defining an outer periphery of the annular guiding space is fixed to a part of the exposed flow-guiding member defining an inner periphery of the annular guiding space via a plurality of discrete bridges at an area opposite to the spout.

In this case, the annular guiding space can be effectively formed.

Advantageous Effects of Invention

According to the above feature, since the water located at the outer periphery among the water spouted from the spout is spouted as an annular stream, the water can be spouted at the outer periphery while achieving high guiding characteristics. Therefore, even if the guiding characteristics at a central portion of the spout are deteriorated due to the separate exposed flow-guiding member provided on the spout side of the flow-guiding member, generation of a split of the spouted water can be remarkably prohibited, so that extremely high guiding characteristics can be achieved.

For example, when the exposed flow-guiding member made of an elastic member has an outer-periphery guiding surface at an area on the spout side of the exposed flow-guiding member, the outer-periphery guiding surface has an annular shape, and an annular guiding space is formed between the outer-periphery guiding surface and the spout forming member, generation of a split of the spouted water can be remarkably prohibited, so that extremely high guiding characteristics can be achieved. In addition, when the exposed flow-guiding member is made of an elastic member, the exposed flow-guiding member can be manually pressed and deformed by a user, so that calcium precipitated thereon can be easily removed therefrom. That is to say, the maintenance operation can be easily carried out.

DESCRIPTION OF EMBODIMENTS

With reference to the attached drawings, we explain a spout apparatus according to an embodiment of the present invention. For easy understanding, the same components through the drawings are accompanied with the same numerical signs as much as possible. Overlapped explanation is omitted.

Figure 1:
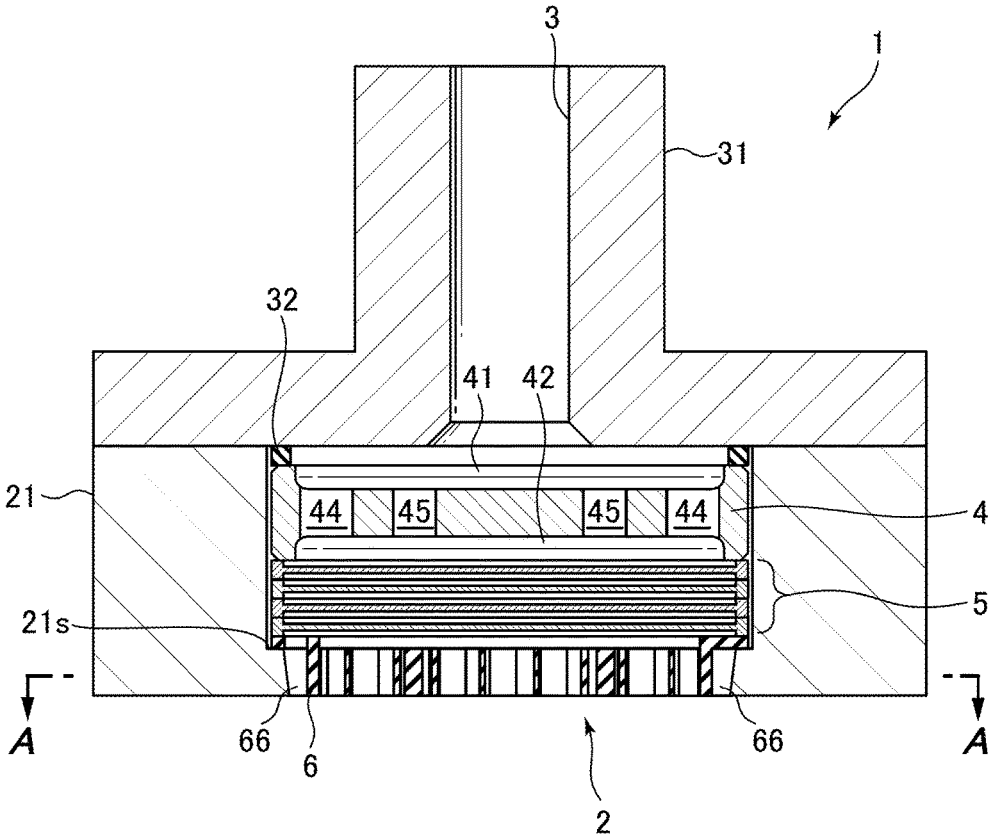
FIG. 1 is a schematic longitudinal section view of a spout apparatus according to an embodiment of the present invention.
Figure 2:
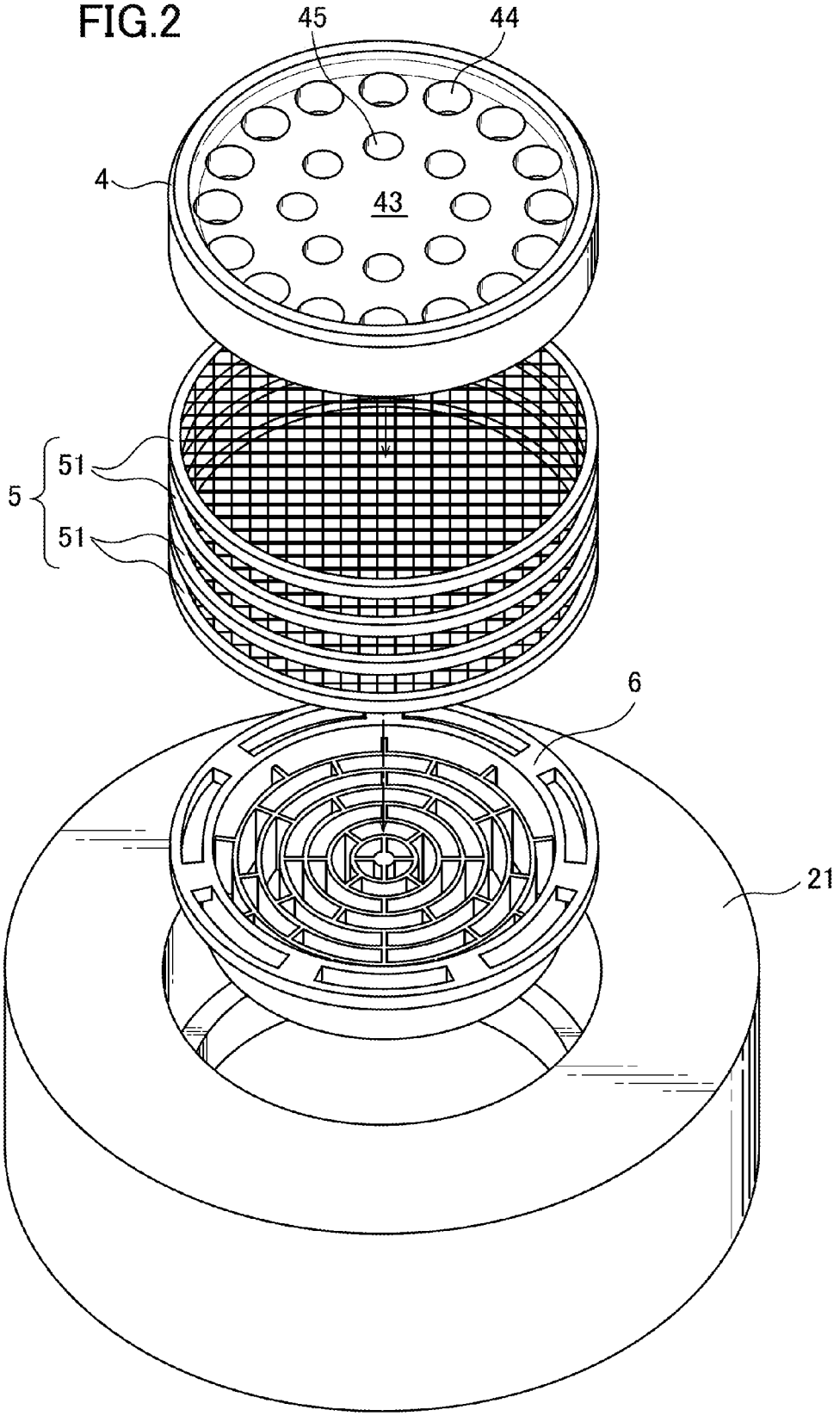
FIG. 2 is an exploded perspective view of a main part of the spout apparatus of FIG. 1.
Figure 3:
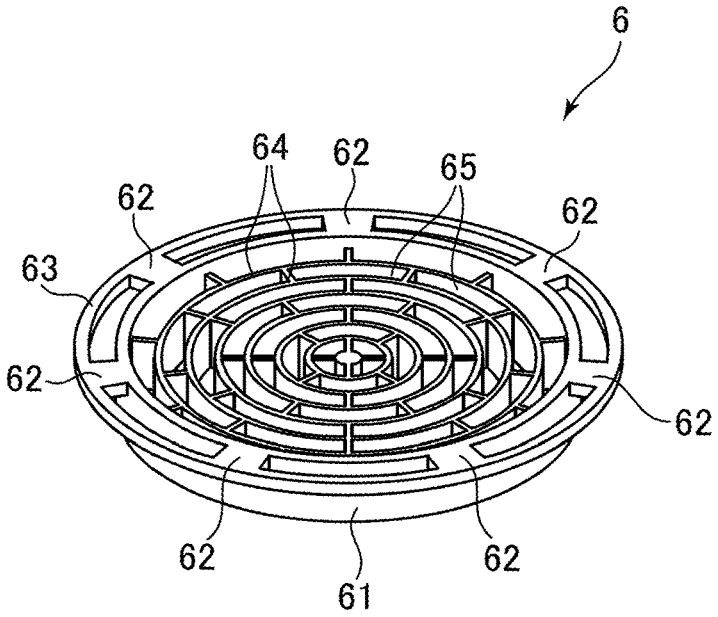
FIG. 3 is a perspective view of an exposed flow-guiding member of the spout apparatus of FIG. 1 when viewed from above.
Figure 4:
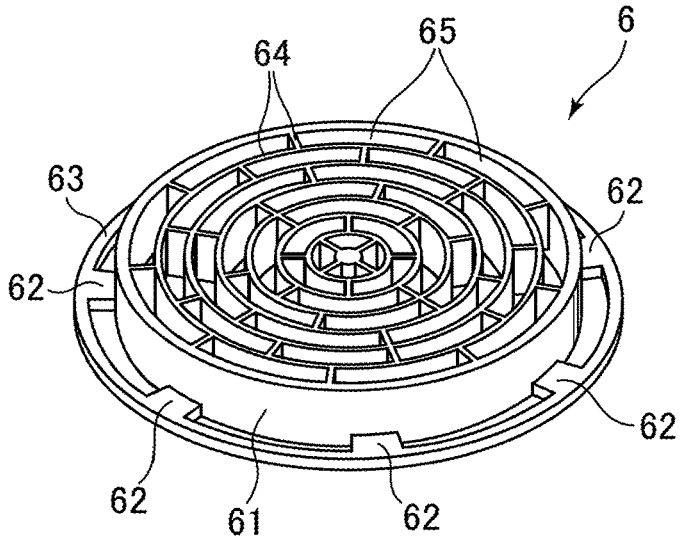
FIG. 4 is a perspective view of the exposed flow-guiding member of FIG. 3 when viewed from below.
Figure 5:
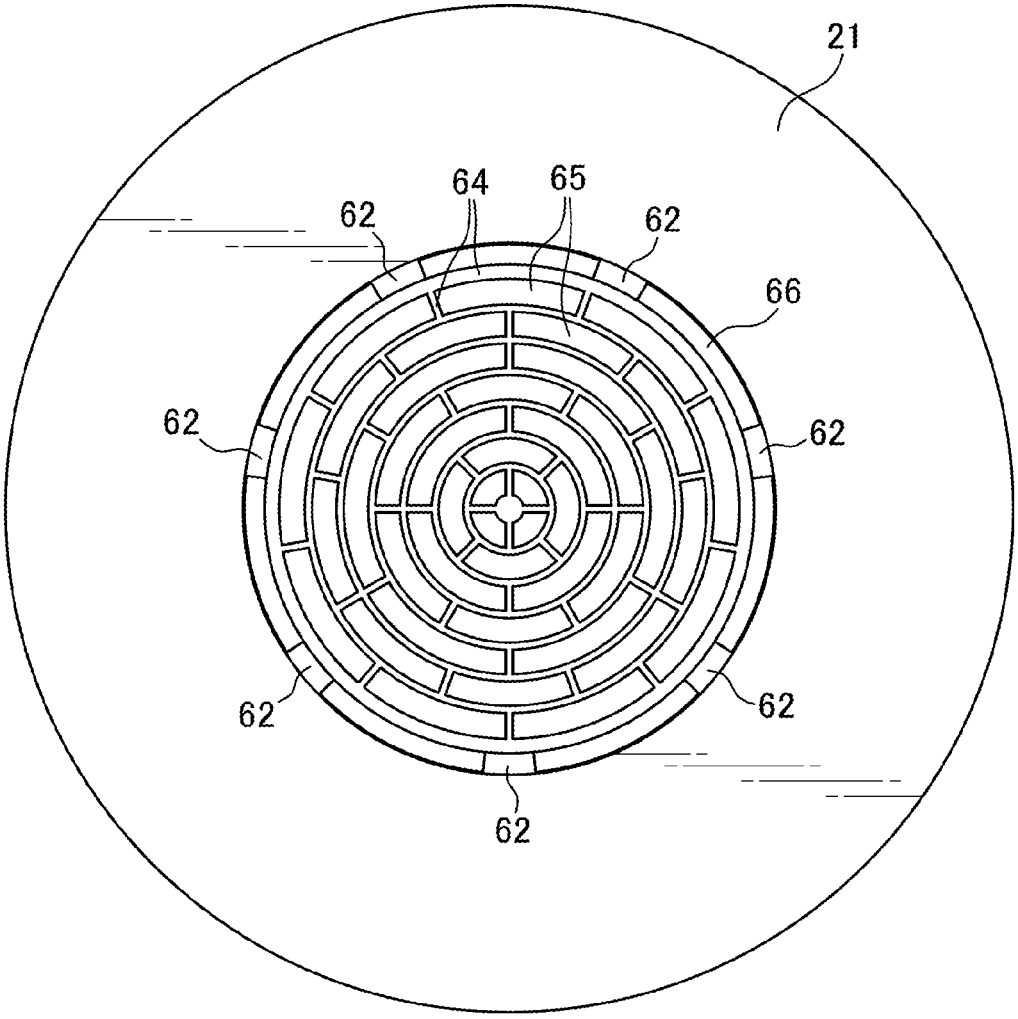
FIG. 5 is a bottom view of the spout apparatus of FIG. 1.
Figure 6:
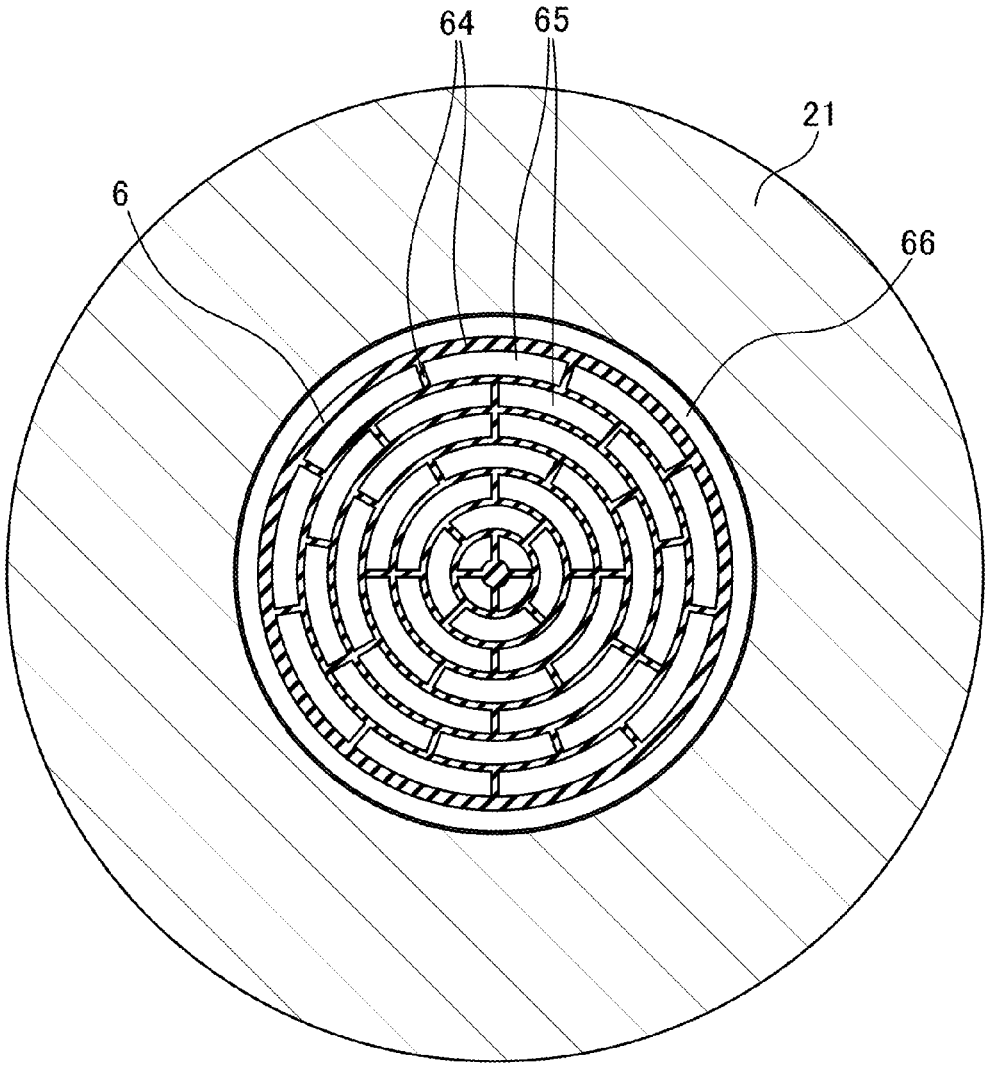
FIG. 6 is a cross section view taken along plane (line) A-A of the spout apparatus of FIG. 1.

FIG. 1 is a schematic longitudinal section view of a spout apparatus according to an embodiment of the present invention. FIG. 2 is an exploded perspective view of a main part of the spout apparatus of FIG. 1. FIG. 3 is a perspective view of an exposed flow-guiding member of the spout apparatus of FIG. 1 when viewed from above. FIG. 4 is a perspective view of the exposed flow-guiding member of FIG. 3 when viewed from below. FIG. 5 is a bottom view of the spout apparatus of FIG. 1. FIG. 6 is a cross section view taken along plane (line) A-A of the spout apparatus of FIG. 1.

As shown in FIGS. 1 to 6, a spout apparatus 1 of the present embodiment includes a spout forming member 21 configured to form a spout 2, which is opened downward in FIG. 1. A first flow-guiding member 4 and a second flow-guiding member 5 are provided inside the spout forming member 21, as a flow-guiding member for guiding a water stream on an upstream side of the spout 2.

In particular, as shown in FIG. 2, the first flow-guiding member 4 is made of a disk-shaped member. A central portion thereof is a shielding portion 43. Sixteen through-holes 44 extending in a water-flow direction are distributed in a circumferential direction at an area on the outer-periphery side. In addition, eight through-holes 45 extending in the water-flow direction are distributed in a circumferential direction at a concentric area, whose diameter is half that of the through-holes 44.

In addition, as shown in FIG. 2, the second flow-guiding member 5 is formed by four guiding nets 51, each of which is made of a mesh member. The four guiding nets 41 are layered on each other. The second flow-guiding member 5 is arranged adjacent to a downstream side of the first flow-guiding member 4.

On the other hand, as shown in FIG. 1, a water channel 3 configured to supply the water is provided on an upstream side of the first flow-guiding member 4. In the present embodiment, the water channel 3 is formed inside a water channel forming member 31, which is arranged adjacent to an upstream side of the spout forming member 21. The spout forming member 21 and the water channel forming member 31 can be fixed to each other in a suitable manner, such as threaded engagement, snap fitting, adhesive joint, and welding.

In addition, as shown in FIG. 1, a first stay chamber 41 is formed between the water channel 3 and the first flow-guiding member 4, and a second stay chamber 42 is formed between the first flow-guiding member 4 and the second flow-guiding member 5. The downstream end of the water channel 3 is arranged within an area corresponding to the shielding portion 43, so that the water supplied from the water channel 3 can temporarily stay in the first stay chamber 41 after colliding with the shielding portion 43.

As shown in FIGS. 1 to 6, an exposed flow-guiding member 6 made of an elastic material is arranged inside the spout forming member 21 and on a spout side (on a lower side in FIG. 1) of the second flow-guiding member 5. The elastic material may be silicon rubber, NBR (nitrile butyl rubber), fluororubber, or the like.

The exposed flow-guiding member 6 has an outer-periphery guiding surface 61 at an area on the spout side (on the lower side in FIG. 1) of the exposed flow-guiding member 6. In the present embodiment, the outer-periphery guiding surface 61 has a cylindrical shape. To the contrary, the exposed flow-guiding member 6 has a ring-shaped flange 63, whose diameter is greater, via seven discrete bridges 62 arranged in a circumferential direction at substantially regular intervals, at an area opposite to the spout 2 (on an upper side in FIG. 1). The ring-shaped flange 63 is sandwiched between a shoulder portion 21*s* provided on an inside surface of the spout forming member 21 and the second flow-guiding member 5, so that the exposed flow-guiding member 6 is fixed to the spout forming member 21.

According to the above manner, the exposed flow-guiding member 6 is fixed to the spout forming member 21 via the seven discrete bridges 62 as if it is floated. Therefore, the exposed flow-guiding member 6 is sufficiently deformable when a user presses it.

In addition, the exposed flow-guiding member 6 has a plurality of tubular hollow spaces 65 that are separated by a baffle 64 extending in a water-flow direction. In the present embodiment, the plurality of tubular hollow spaces 65 is formed by concentric ring-shaped areas in plan view further being divided in a circumferential direction (see FIGS. 3 to 6).

The baffle 64 has a latticed pattern having intersections in plan view. The expression "latticed pattern" in the specification includes not only a manner in which linear lines are intersected with each other, but also a manner in which a linear line and a curve line are intersected with each other and/or a manner in which curve lines (whose curvatures may be different) are intersected with each other. Furthermore, the expression "latticed pattern" in the specification includes not only a manner in which four sides (not limited to linear sections, but including arc sections or the like) define one cell, but also a manner in which three sides or five or more sides define one cell. The manner in which six equal sides define one cell is called a "honeycomb pattern". In addition, the expression "latticed pattern" in the specification also includes a manner in which a shape having no recognizable "side", such as a circle or an oval, defines one cell.

Figure 7A:
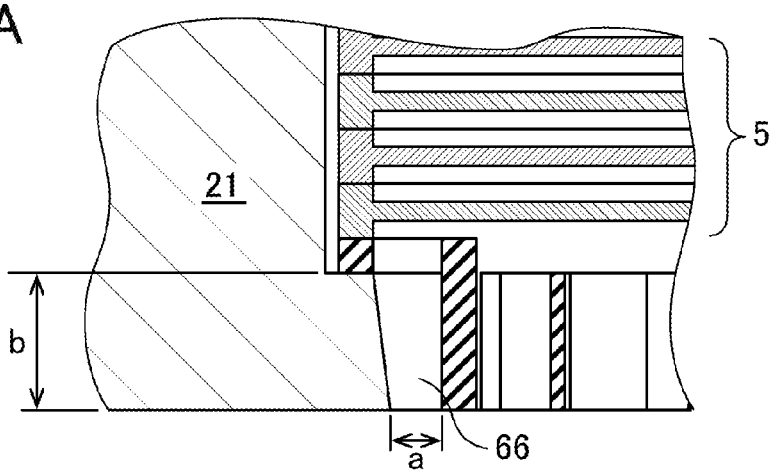
FIGS. 7A to 7C are schematic longitudinal section views for explaining the relationship between a width and a length of an annular guiding space.

In addition, an annular guiding space 66 is formed between the outer-periphery guiding surface 61 and the spout forming member 21. In the present embodiment, the annular guiding space 66 is ring-shaped in plan view. As shown in FIG. 7A, a length b of the annular guiding space 66 in the water-flow direction is greater than a width a of the annular guiding space 66 in a radial direction at a downstream end thereof.

Figure 7B:
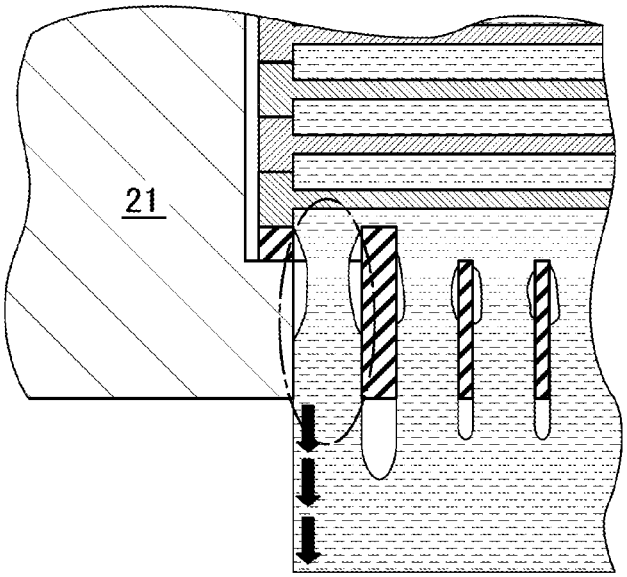
Figure 7C:
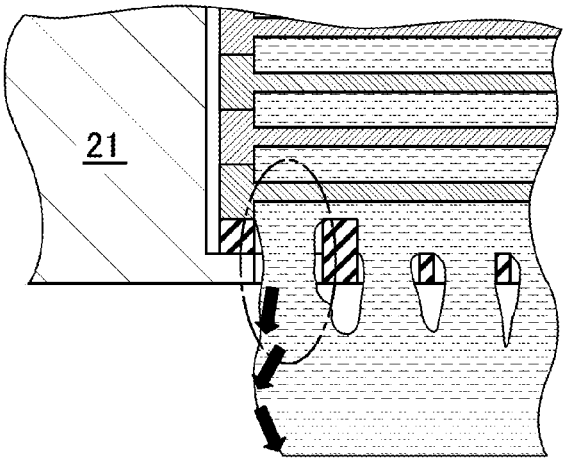

When the above size conditions are satisfied, even if the water stream contracts after entering the annular guiding space 66, the water stream is guided by the annular guiding space 66 sufficiently enough to be the annular stream without any split. Thus, the entire guiding characteristics can be maintained. That is to say, as shown in FIG. 7B, if the length b is long enough to satisfy the above relationship b>a, the water stream that has contracted once can be sufficiently guided and then spouted. FIG. 7C shows a comparative state in which the water stream that has contracted once is not sufficiently guided and spouted.

Figure 8A:
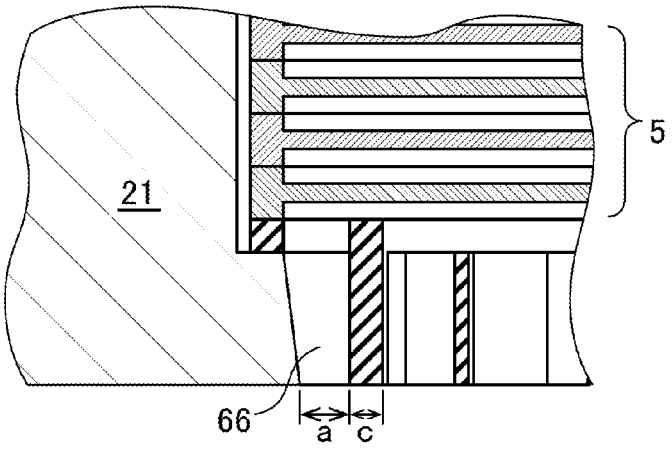
FIGS. 8A and 8B are schematic longitudinal section views for explaining the relationship between the width of the annular guiding space and a thickness at an outermost and most downstream end of the exposed flow-guiding member.

In addition, in the present embodiment, as shown in FIG. 8A, a thickness c at an outermost and most downstream end of the exposed flow-guiding member 6 is not more than a width a of the annular guiding space 66 as seen in a direction of the thickness.

Figure 8B:
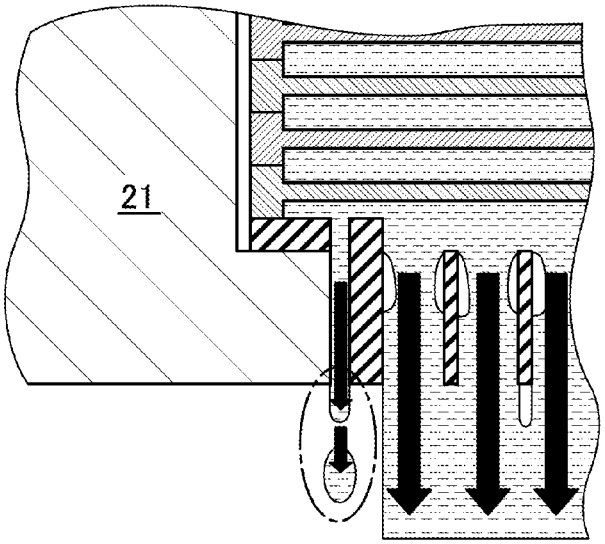

When the above size conditions are satisfied, it is possible to maintain a relatively large amount of the water spouted through the annular guiding space 66, which can achieve a film-like (cylindrical) water stream of the spouted water. The film-like water stream draws the spouted water, so that the entire shape of the water stream spouted from the spout 2 can be maintained. That is to say, the guiding characteristics can be further improved. Specifically, as shown in FIG. 8B, if the length a is not long enough, the annular guiding space 66 is so narrow that the water stream spouted from the spout 2 tends to be granulated. That is to say, the guiding characteristics are not good. (When the flow-channel width is narrow (the amount of flowing water is small), the spouted water stream tends to be granulated. In detail, the outer peripheral part of the water stream tends to be granulated, which may deteriorate the shape of the water stream.)

Figure 9:
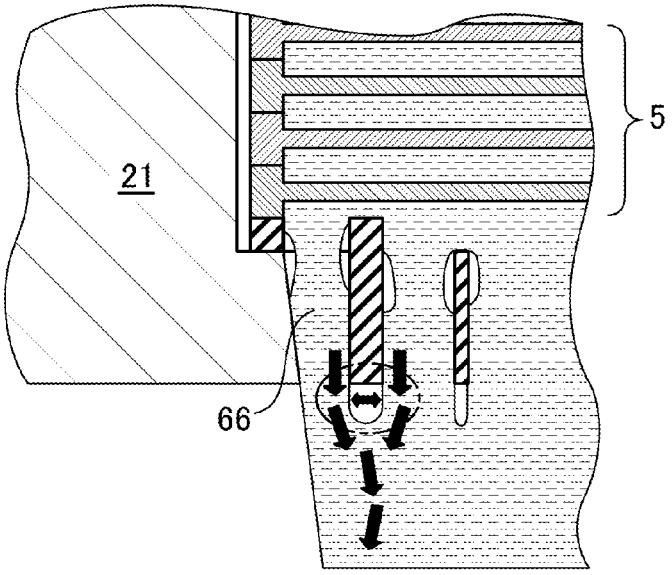
FIG. 9 is a schematic longitudinal section view for explaining an inclination provided on an inside surface of a spout.

In addition, in the present embodiment, as shown in FIG. 9, at least an area on a downstream-end side of the inside surface of the spout 2 has a tapered shape (frusto-conical shape) toward a downstream end of the spout 2. Thus, it is possible to effectively reduce the possibility that the split of the spouted water is caused by the thickness at the outermost and most downstream end of the exposed flow-guiding member 6. (The water that has flown through the slit portion tends to approach a centerline, which inhibits the split of the spouted water.)

Besides, as shown in FIG. 1, a ring-shaped seal 32 is provided between an upstream-side surface of the first flow-guiding member 4 and the water channel forming member 31. In addition, the gap between a downstream-side surface of the second flow-guiding member 5 (the guiding net 51 on the most downstream side) and an upstream-side surface of the exposed flow-guiding member 6 is so small that the exposed flow-guiding member 6 can contact with the second flow-guiding member 5 when the exposed flow-guiding member 6 is elastically deformed. That is to say, the exposed flow-guiding member 6 and the second flow-guiding member 5 are provided close to each other.

Thus, when the exposed flow-guiding member 6 is manually deformed for a maintenance operation thereof, the second flow-guiding member 5 can be also deformed through the deformation of the exposed flow-guiding member 6. That is to say, a maintenance operation for the second flow-guiding member 5 can be carried out at the same time.

Next, an operation of the present embodiment is explained hereinafter.

The water supplied from the water channel 3 collides with the shielding portion 43 of the first flow-guiding member 4 (or with the water that has reversed after colliding with the shielding portion 43) so that the water temporarily stays in the first stay chamber 41. Thereby, a water pressure is maintained in the first stay chamber 41. Thereafter, the water that has stayed in the first stay chamber 41 is pushed out by the water supplied from the upstream side, so that the water flows downstream through the through-holes 44 and the through-holes 45.

The water flown out through the through-holes 44 and the through-holes 45 is divided into a water stream that goes straight through the second flow-guiding member 5 toward the spout 2, and another water stream that goes toward a center of the second stay chamber 42 because of some surface tension and/or some negative pressure generated in the second stay chamber 42. The latter water stream is gathered in the center, and then flows out through the second flow-guiding member 5 toward the spout 2.

When the water flows through the four guiding nets 51 of the second flow-guiding member 5, velocity vector of the water is aligned in the water-flow direction. Thereafter, the aligned water streams are spouted out from the spout 2 through the plurality of tubular hollow spaces 65 and the annular guiding space 66 on the outer periphery of the exposed flow-guiding member 6. As a result, the water spouted from the spout 2 is unified into one water stream. When the above embodiment is used as an overhead shower, the one water stream lands on the human body and forms a water film along the human body, which can envelop the entire human body. Thus, if the water stream consists of a hot water stream, a deep body temperature of the human body can be effectively increased.

In particular, according to the present embodiment, the exposed flow-guiding member 6 has the outer-periphery guiding surface 61 at the area on the spout side of the exposed flow-guiding member 6, the outer-periphery guiding surface has the annular shape, and the annular guiding space 66 is formed between the outer-periphery guiding surface 61 and the spout forming member 21. Thus, generation of a split of the spouted water can be remarkably prohibited, so that extremely high guiding characteristics can be achieved.

In addition, according to the present embodiment, the annular guiding space 66 is ring-shaped in plan view, and the length b of the annular guiding space 66 in the water-flow direction is greater than the width a of the annular guiding space 66 in the radial direction at the downstream end thereof (see FIG. 7A). Thus, even if the water stream contracts after entering the annular guiding space 66, the water stream is guided by the annular guiding space 66 sufficiently enough to be the annular stream without any split, so that the entire guiding characteristics can be maintained.

In addition, according to the present embodiment, the thickness c at the outermost and most downstream end of the exposed flow-guiding member 6 is not more than the width a of the annular guiding space 66 as seen in the direction of the thickness g (see FIG. 8A). Thus, it is possible to maintain a relatively large amount of the water spouted through the annular guiding space 66, which can achieve a film-like (cylindrical) water stream of the spouted water. The film-like water stream draws the spouted water, so that the entire shape of the water stream spouted from the spout 2 can be maintained. That is to say, the guiding characteristics can be further improved.

In addition, according to the present embodiment, at least the area on the downstream-end side of the inside surface of the spout 2 has the tapered shape (frusto-conical shape) toward the downstream end of the spout 2 (see FIG. 9). Thus, it is possible to effectively reduce the possibility that the split of the spouted water is caused by the thickness at the outermost and most downstream end of the exposed flow-guiding member 6.

In addition, since the exposed flow-guiding member 6 is made of an elastic material, the exposed flow-guiding member 6 can be manually pressed and deformed by a user, so that calcium precipitated thereon can be easily removed therefrom. That is to say, the maintenance operation for the exposed flow-guiding member 6 can be easily carried out.

In particular, since the exposed flow-guiding member 6 of the present embodiment is fixed to the spout forming member 21 via the seven discrete bridges 62 as if it is floated, the exposed flow-guiding member 6 is sufficiently deformable when a user presses it.

Furthermore, according to the present embodiment, the exposed flow-guiding member 6 and the second flow-guiding member 5 are provided in contiguity with each other. Thus, when the exposed flow-guiding member 6 is manually deformed for the maintenance operation thereof, the second flow-guiding member 5 can be also deformed through the deformation of the exposed flow-guiding member 6. That is to say, the maintenance operation for the second flow-guiding member 5 can be carried out at the same time.

In addition, according to the present embodiment, the exposed flow-guiding member 6 is fixed to the spout forming member 21 via the bridges 62 and the ring-shaped flange 63 at the end opposite to the spout 2. Thus, the annular outer-periphery guiding surface 61 is effectively formed for providing the annular guiding space 66 together with the spout forming member 21.

Furthermore, according to the present embodiment, the water-flow direction is uniformly aligned through the first flow-guiding member 4 and the second flow-guiding member 5, so that the velocity vector is effectively aligned. In addition, the guiding characteristics can be further improved by making each guiding net 51 thicker and/or by making the mesh of each guiding net 51 finer.

Figure 10:
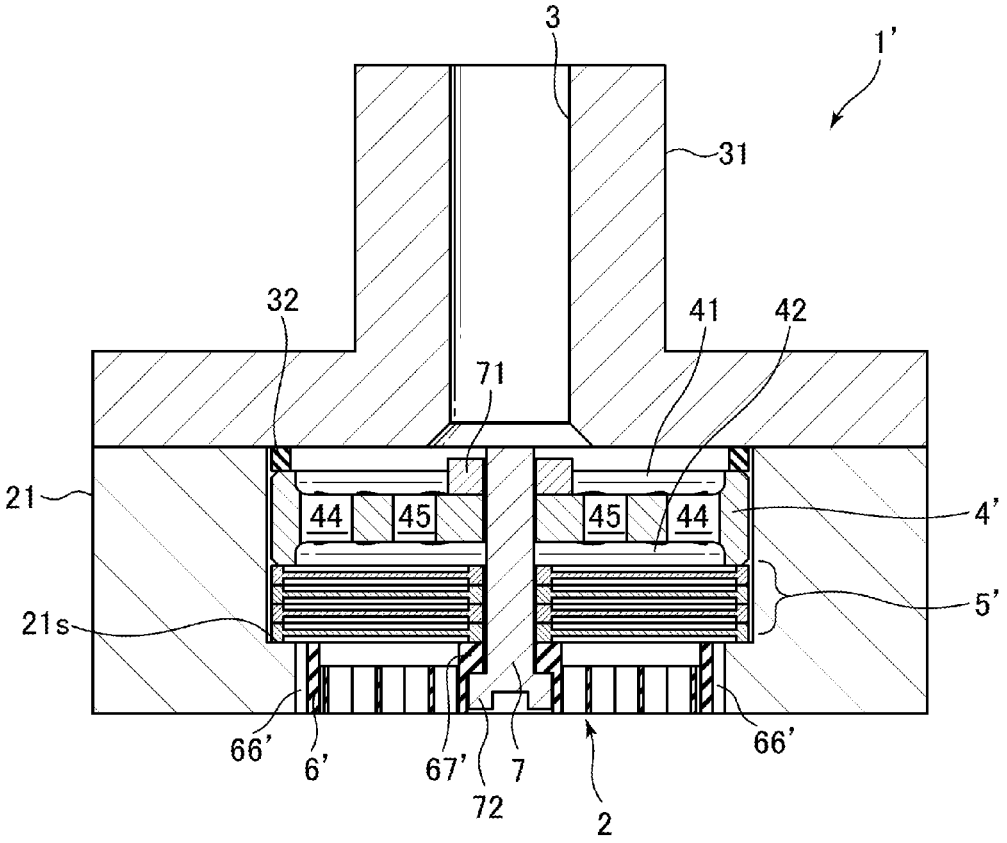
FIG. 10 is a schematic longitudinal section view of a spout apparatus according to another embodiment of the present invention.
Figure 11:
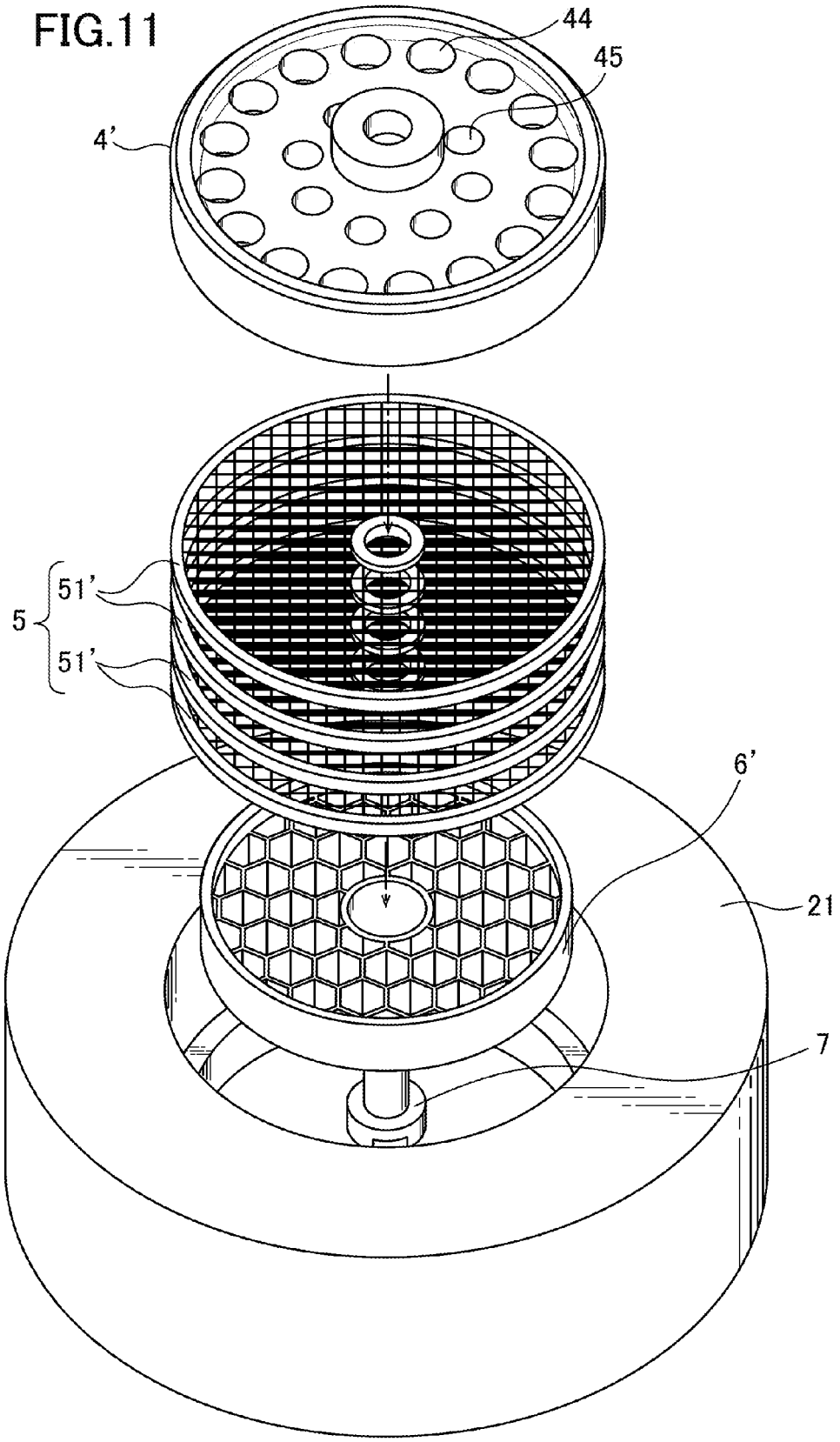
FIG. 11 is an exploded perspective view of a main part of the spout apparatus of FIG. 10.
Figure 12:
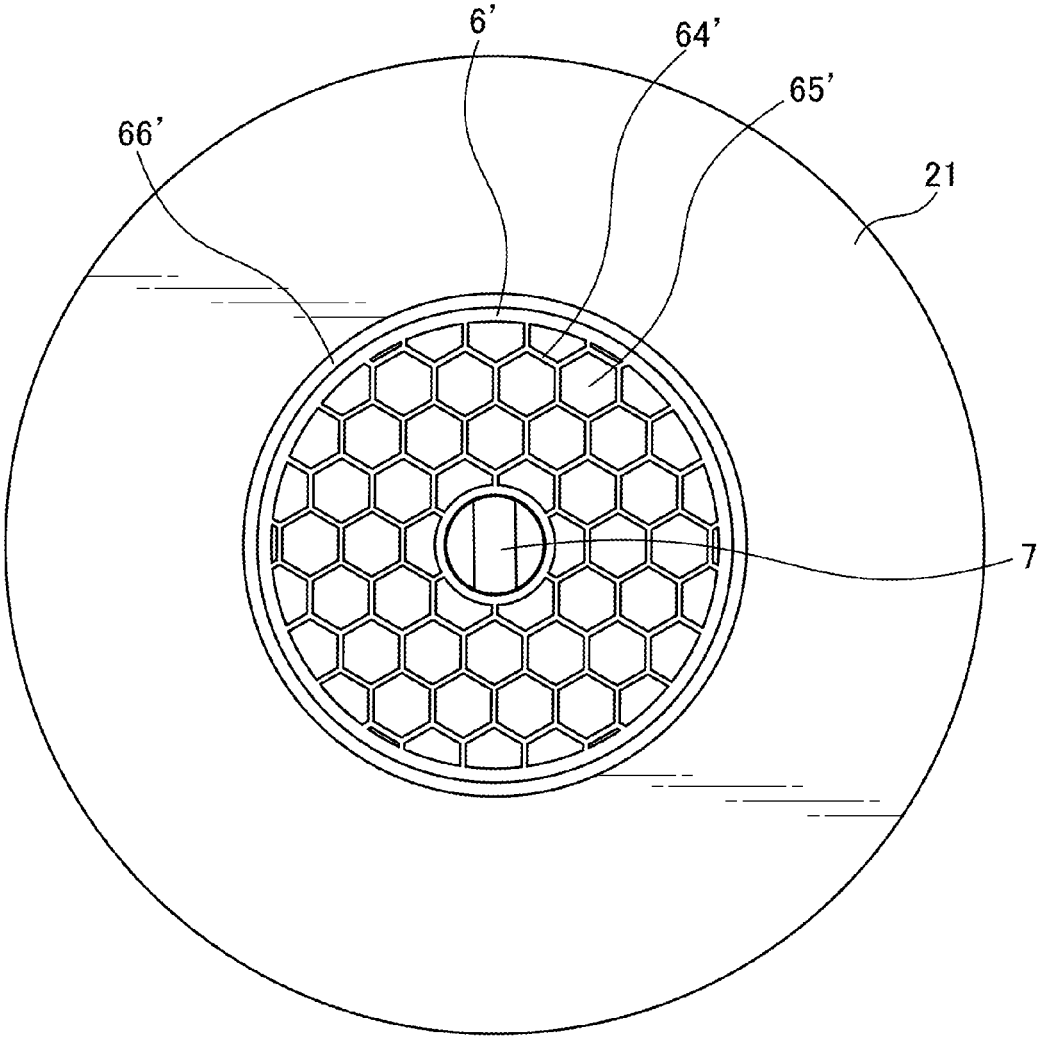
FIG. 12 is a bottom view of the spout apparatus of FIG. 10.

Next, FIG. 10 is a schematic longitudinal section view of a spout apparatus according to another embodiment of the present invention, FIG. 11 is an exploded perspective view of a main part of the spout apparatus of FIG. 10, and FIG. 12 is a bottom view of the spout apparatus of FIG. 10.

As shown in FIGS. 10 to 12, in the spout apparatus 1' of the present embodiment, differently from the previous embodiment explained with reference to FIGS. 1 to 9, a first flow-guiding member 4', a second flow-guiding member 5' (guiding nets 51') and an exposed flow-guiding member 6' are respectively ring-shaped, and a fixing part (central column) 7 extends through them. The fixing part 7 is supported by the first flow-guiding member 4' via a holding ring 71.

In particular, as shown in FIG. 10, the exposed flow-guiding member 6' of the present embodiment has a central diameter-reduced part 67', and does not have any bridge 62 and any ring-shaped flange 63. The central diameter-reduced part 67' is supported by a diameter-increased part 72 of the fixing part 7. That is to say, the exposed flow-guiding member 6' is fixed to the spout forming member 21 via the fixing part 7 and the first flow-guiding member 4'. The second flow-guiding member 5 (guiding nets 51) are placed on the shoulder portion 21*s* of the spout forming member 21.

In addition, a plurality of tubular hollow spaces 65' of the exposed flow-guiding member 6' forms a so-called "honeycomb pattern" in plan view (see FIG. 12).

In the present embodiment, the thickness c at the outermost and most downstream end of the exposed flow-guiding member 6' is substantially the same as the width p of the annular guiding space 66' as seen in the direction of the thickness c. In addition, in the present embodiment, the inside surface of the spout 2 is cylindrical, i.e., does not have any tapered shape toward the downstream end of the spout 2.

The other structure of the present embodiment is substantially the same as that of the previous embodiment explained with reference to FIGS. 1 to 9. In FIGS. 10 to 12, the same parts as those of the previous embodiment are shown by the same reference numerals, and detailed explanation thereof is omitted.

According to the present embodiment as well, the water spouted from the spout 2 is unified into one water stream. When the present embodiment is used as an overhead shower, the one water stream lands on the human body and forms a water film along the human body, which can envelop the entire human body. Thus, if the water stream consists of a hot water stream, a deep body temperature of the human body can be effectively increased.

In particular, according to the present embodiment, the entire side surface of the exposed flow-guiding member 6', which was made of an elastic material, is the annular outer-periphery guiding surface 61', and the annular guiding space 66' is formed between the outer-periphery guiding surface 61' and the spout forming member 21'. Thus, generation of a split of the spouted water can be remarkably prohibited, so that extremely high guiding characteristics can be achieved.

In addition, according to the present embodiment as well, the annular guiding space 66' is ring-shaped in plan view, and the length b of the annular guiding space 66' in the water-flow direction is greater than the width 8 of the annular guiding space 66' in the radial direction at the downstream end thereof (see FIG. 7A). Thus, even if the water stream contracts after entering the annular guiding space 66', the water stream is guided by the annular guiding space 66' sufficiently enough to be the annular stream without any split, so that the entire guiding characteristics can be maintained.

In addition, since the exposed flow-guiding member 6' is made of an elastic material, the exposed flow-guiding member 6' can be manually pressed and deformed by a user, so that calcium precipitated thereon can be easily removed therefrom. That is to say, the maintenance operation for the exposed flow-guiding member 6' can be easily carried out.

In particular, since the exposed flow-guiding member 6' of the present embodiment is fixed to the spout forming member 21 via the fixing part 7 as if it is floated, the exposed flow-guiding member 6' is sufficiently deformable when a user presses it.

Furthermore, according to the present embodiment, the exposed flow-guiding member 6' and the second flow-guiding member 5' are provided in contiguity with each other. Thus, when the exposed flow-guiding member 6' is manually deformed for the maintenance operation thereof, the second flow-guiding member 5' can be also deformed through the deformation of the exposed flow-guiding member 6'. That is to say, the maintenance operation for the second flow-guiding member 5' can be carried out at the same time.

In each of the above embodiments, the exposed flow-guiding member 6, 6' is provided separately from the second flow-guiding member 5, 5'. Thus, the second flow-guiding member 5, 5' is effectively protected from contact of any foreign body or the like. In order to obtain this protection effects, it is not necessary that the exposed flow-guiding member 6, 6' is an elastic member. In other words, even if the exposed flow-guiding member 6, 6' is made of a non-elastic material in the above embodiments, such a spout apparatus is included in the scope of disclosed contents of the present invention. For example, the exposed flow-guiding member 6, 6' may be made of a member which is harder to be deformed than the second flow-guiding member 5, 5', such as hard plastic or the like. In this case as well, the exposed flow-guiding member 6, 6' can effectively protect the second flow-guiding member 5, 5'.

In addition, in each of the above embodiments, the exposed flow-guiding member 6, 6' has the annular outer-periphery guiding surface 61, 61' at the area on the spout side of the exposed flow-guiding member 6, 6', and the annular guiding space 66, 66' is formed between the outer-periphery guiding surface 61, 61' and the spout forming member 21. However, instead of this structure, an outer-periphery area of the exposed flow-guiding member on the spout side may have an annular guiding space in the outer-periphery area itself. In such a case, for example, the outer-periphery surface of the exposed flow-guiding member may be fitted into an area of the spout forming member on the spout side.

Figure 13:
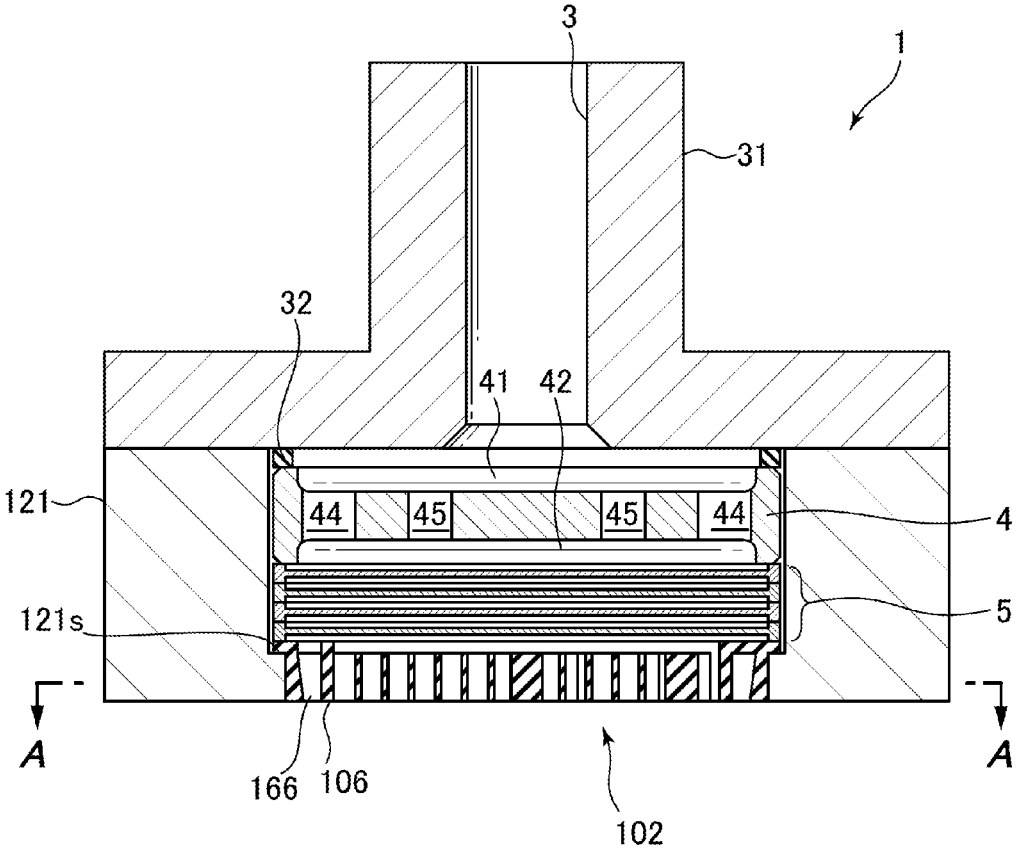
FIG. 13 is a schematic longitudinal section view of a spout apparatus according to further another embodiment of the present invention.
Figure 14:
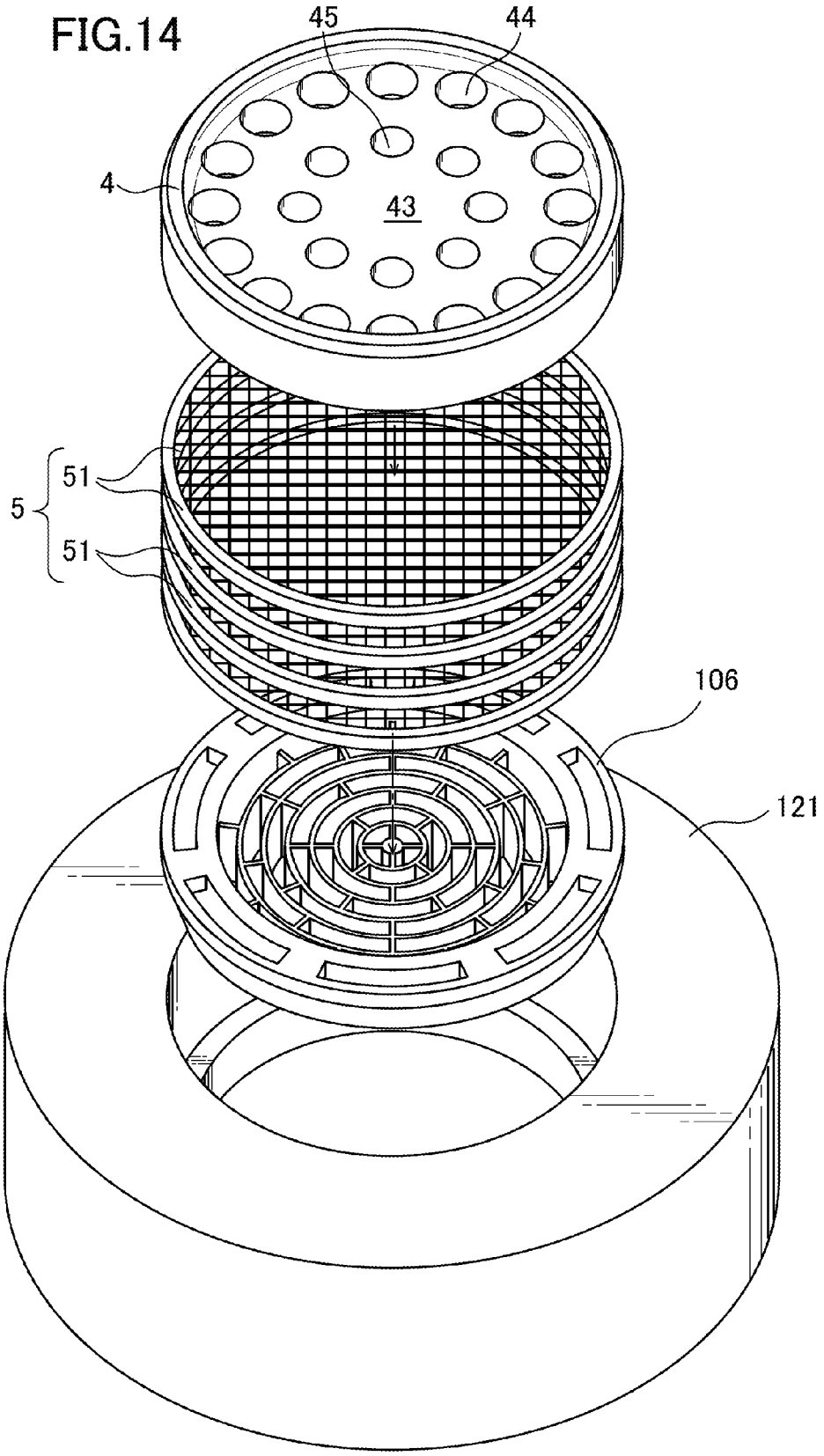
FIG. 14 is an exploded perspective view of a main part of the spout apparatus of FIG. 13.
Figure 15:
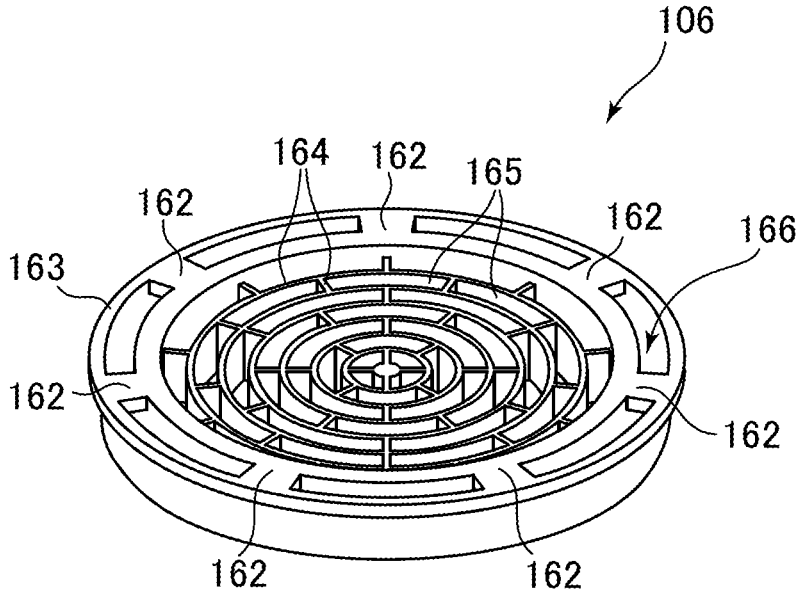
FIG. 15 is a perspective view of an exposed flow-guiding member of the spout apparatus of FIG. 13 when viewed from above.
Figure 16:
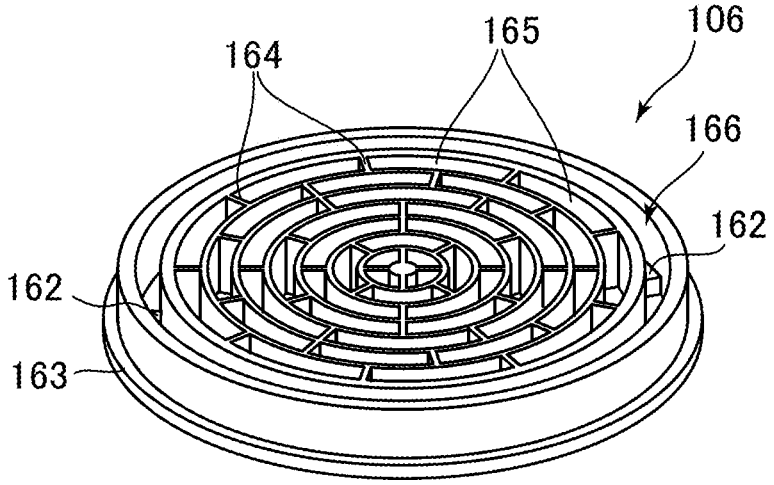
FIG. 16 is a perspective view of the exposed flow-guiding member of FIG. 15 when viewed from below.
Figure 17:
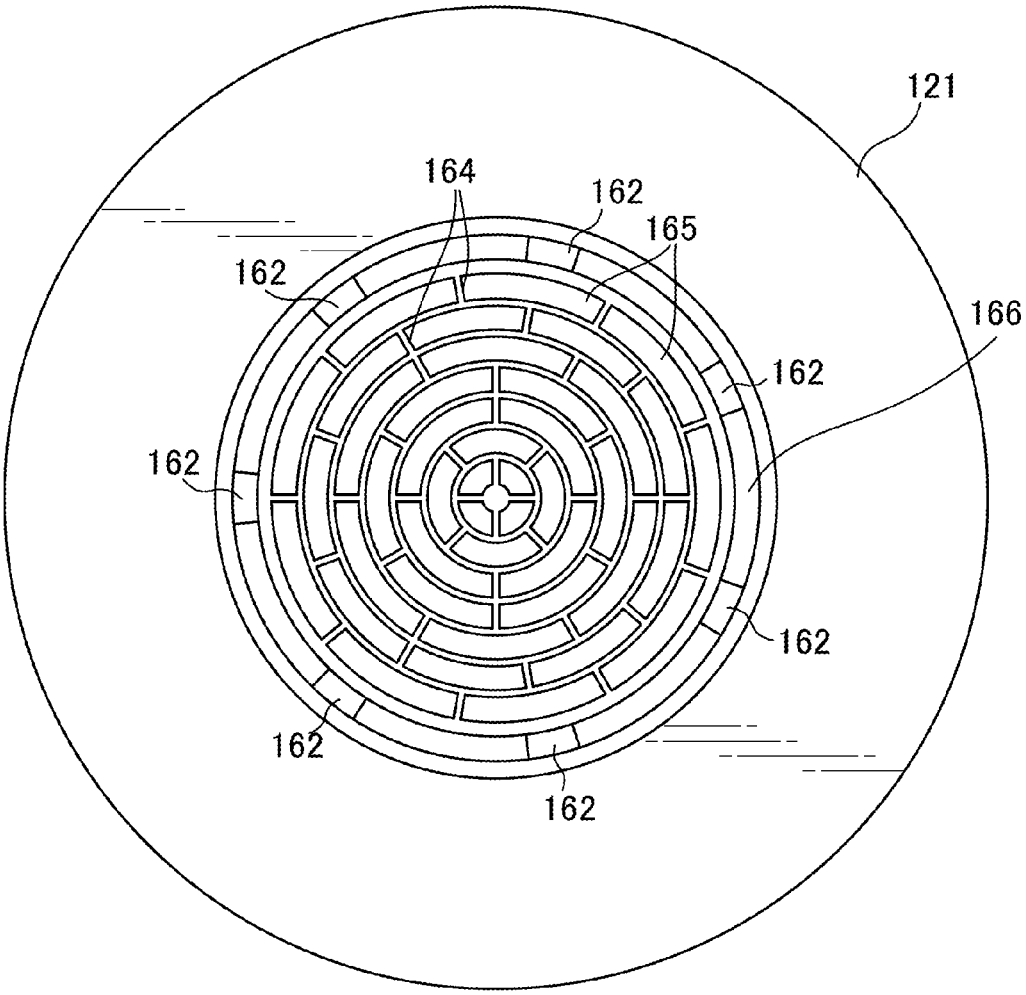
FIG. 17 is a bottom view of the spout apparatus of FIG. 13.
Figure 18:
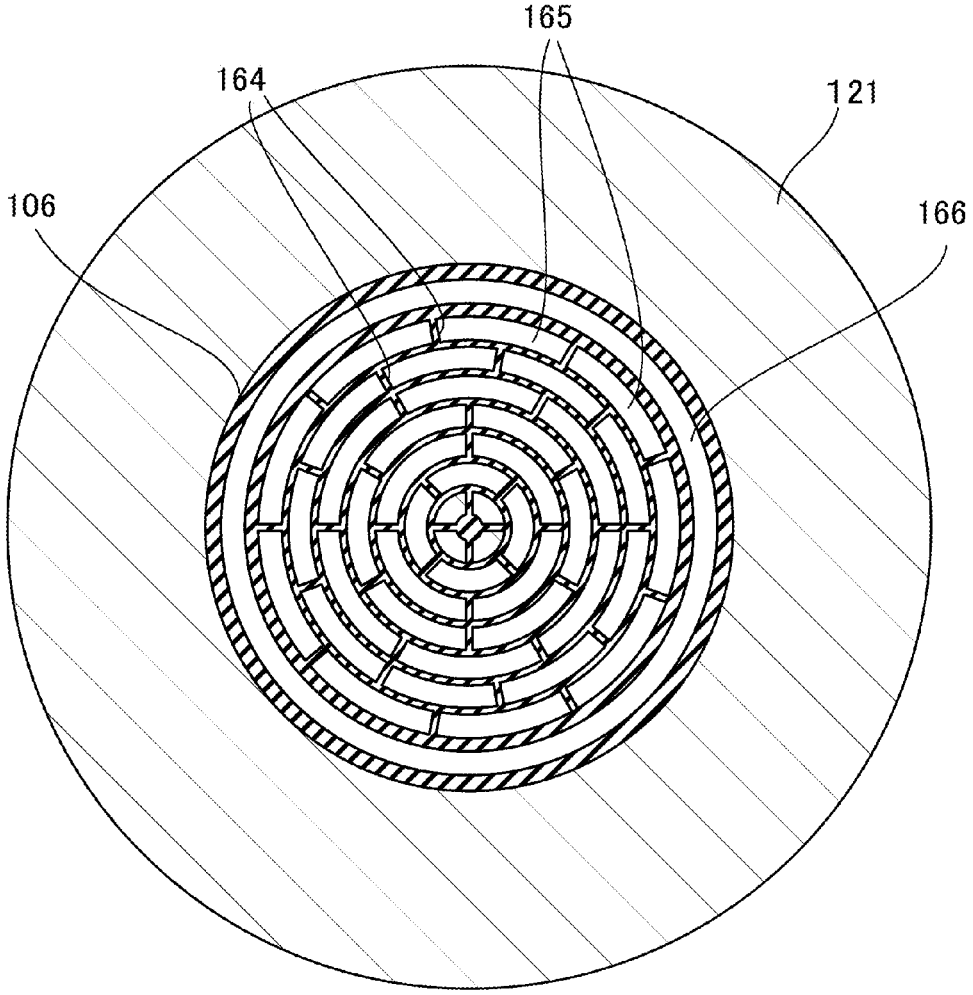
FIG. 18 is a cross section view taken along plane (line) A-A of the spout apparatus of FIG. 13.

FIG. 13 is a schematic longitudinal section view of a spout apparatus according to such an embodiment, FIG. 14 is an exploded perspective view of a main part of the spout apparatus of FIG. 13, FIG. 15 is a perspective view of an exposed flow-guiding member of the spout apparatus of FIG. 13 when viewed from above, FIG. 16 is a perspective view of the exposed flow-guiding member of FIG. 15 when viewed from below, FIG. 17 is a bottom view of the spout apparatus of FIG. 13, and FIG. 18 is a cross section view taken along plane (line) A-A of the spout apparatus of FIG. 13.

As shown in FIG. 13 to 18, in the spout apparatus 101 of the present embodiment, an exposed flow-guiding member 106 made of an elastic material is arranged inside a spout forming member 121 on a spout side (on a lower side in FIG. 13) with respect to the second flow-guiding member 5. The elastic material may be silicon rubber, NBR (nitrile butyl rubber), fluororubber, or the like. Alternatively, as described above, the exposed flow-guiding member 106 may be made of a non-elastic material.

An outer-periphery area of the exposed flow-guiding member 106 defines an annular guiding space 166 at an area on the spout side (on the lower side in FIG. 13) of the exposed flow-guiding member 106. In the present embodiment, the annular guiding space 166 is ring-shaped in plan view. A portion of the exposed flow-guiding member 106 defining an inside periphery of the annular guiding space 166 and another portion of the exposed flow-guiding member 106 defining an outside periphery of the annular guiding space 166 are fixed to each other via seven discrete bridges 162 arranged in a circumferential direction at substantially regular intervals, at an area opposite to the spout 102 (on an upper side in FIG. 13). In addition, the portion of the exposed flow-guiding member 106 defining the outside periphery of the annular guiding space 166 has a ring-shaped flange 163, whose diameter is greater, at the area opposite to the spout 102 (on the upper side in FIG. 13). The ring-shaped flange 163 is sandwiched between a shoulder portion 121*s* provided on an inside surface of the spout forming member 121 and the second flow-guiding member 5, so that the exposed flow-guiding member 106 is fixed to the spout forming member 121. In addition, the outer-periphery surface of the exposed flow-guiding member 106 is fitted into an area of the spout forming member 121 on the spout side.

According to the above manner, the portion of the exposed flow-guiding member 106 inner than the annular guiding space 166 is fixed to the portion of the exposed flow-guiding member 106 defining the outside periphery of the annular guiding space 166 and the spout forming member 21 via the seven discrete bridges 162 as if it is floated. Therefore, the portion of the exposed flow-guiding member 106 inner than the annular guiding space 166 is sufficiently deformable when a user presses it.

In addition, the portion of the exposed flow-guiding member 106 inner than the annular guiding space 166 has a plurality of tubular hollow spaces 165 that are separated by a baffle 164 extending in a water-flow direction. In the present embodiment, the plurality of tubular hollow spaces 165 is formed by concentric ring-shaped areas in plan view further being divided in a circumferential direction (see FIGS. 15 to 18).

The baffle 164 has a latticed pattern having intersections in plan view. As described above, the expression "latticed pattern" in the specification includes not only a manner in which linear lines are intersected with each other, but also a manner in which a linear line and a curve line are intersected with each other and/or a manner in which curve lines (whose curvatures may be different) are intersected with each other. Furthermore, the expression "latticed pattern" in the specification includes not only a manner in which four sides (not limited to linear sections, but including arc sections or the like) define one cell, but also a manner in which three sides or five or more sides define one cell. In addition, the expression "latticed pattern" in the specification also includes a manner in which a shape having no recognizable "side", such as a circle or an oval, defines one cell.

Figure 19A:
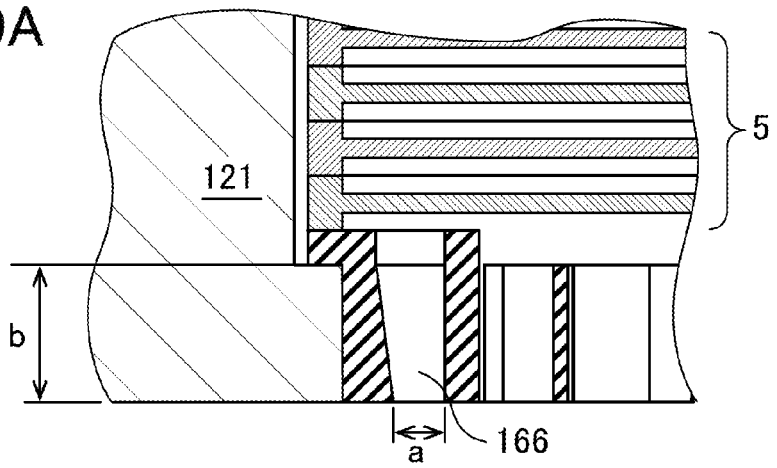
FIGS. 19A to 19C are schematic longitudinal section views for explaining the relationship between a width and a length of an annular guiding space.

In addition, in the present embodiment, as shown in FIG. 19A, a length b of the annular guiding space 166 in the water-flow direction is greater than a width a of the annular guiding space 166 in a radial direction at a downstream end thereof.

Figure 19B:
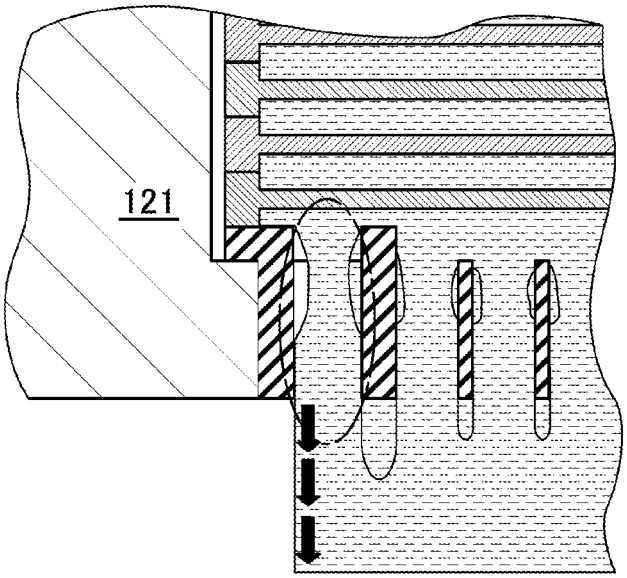
Figure 19C:
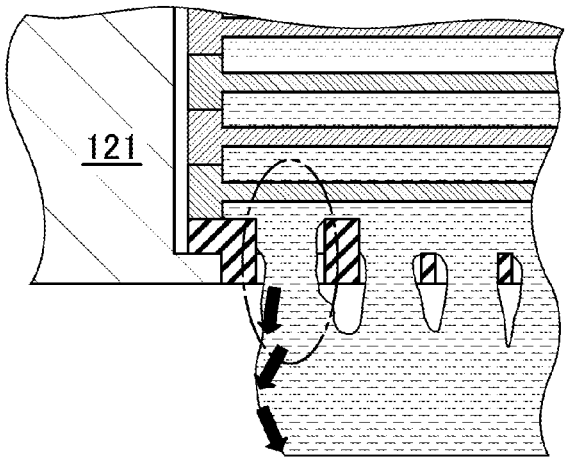

When the above size conditions are satisfied, even if the water stream contracts after entering the annular guiding space 166, the water stream is guided by the annular guiding space 166 sufficiently enough to be the annular stream without any split. Thus, the entire guiding characteristics can be maintained. That is to say, as shown in FIG. 19B, if the length b is long enough to satisfy the above relationship b>a, the water stream that has contracted once can be sufficiently guided and then spouted. FIG. 19C shows a comparative state in which the water stream that has contracted once is not sufficiently guided and spouted.

Figure 20A:
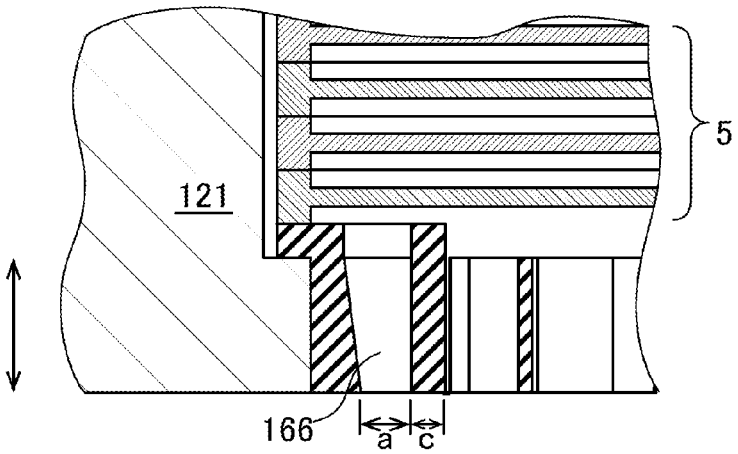
FIGS. 20A and 20B are schematic longitudinal section views for explaining the relationship between the width of the annular guiding space and a thickness at an most downstream end of a portion of the exposed flow-guiding member defining an inside periphery of the annular guiding space.

In addition, in the present embodiment, as shown in FIG. 20A, a thickness c at an most downstream end of the portion of the exposed flow-guiding member 106 defining the inside periphery of the annular guiding space 166 is not more than a width a of the annular guiding space 166 as seen in a direction of the thickness.

Figure 20B:
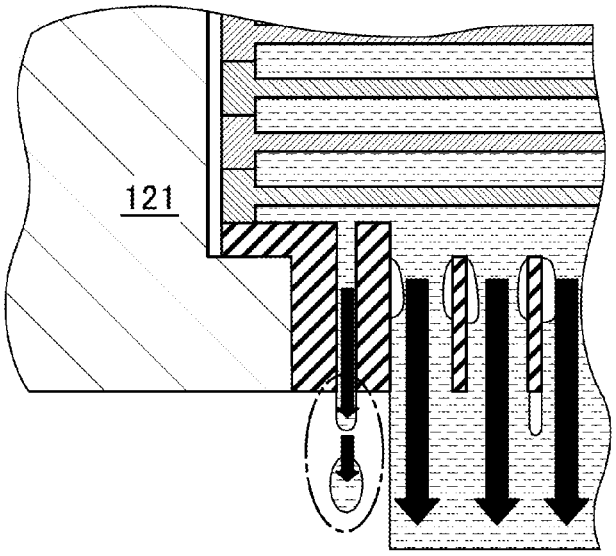

When the above size conditions are satisfied, it is possible to maintain a relatively large amount of the water spouted through the annular guiding space 166, which can achieve a film-like (cylindrical) water stream of the spouted water. The film-like water stream draws the spouted water, so that the entire shape of the water stream spouted from the spout 102 can be maintained. That is to say, the guiding characteristics can be further improved. Specifically, as shown in FIG. 20B, if the length a is not long enough, the annular guiding space 166 is so narrow that the water stream spouted from the spout 102 tends to be granulated. That is to say, the guiding characteristics are not good. (When the flow-channel width is narrow (the amount of flowing water is small), the spouted water stream tends to be granulated. In detail, the outer peripheral part of the water stream tends to be granulated, which may deteriorate the shape of the water stream.)

Figure 21:
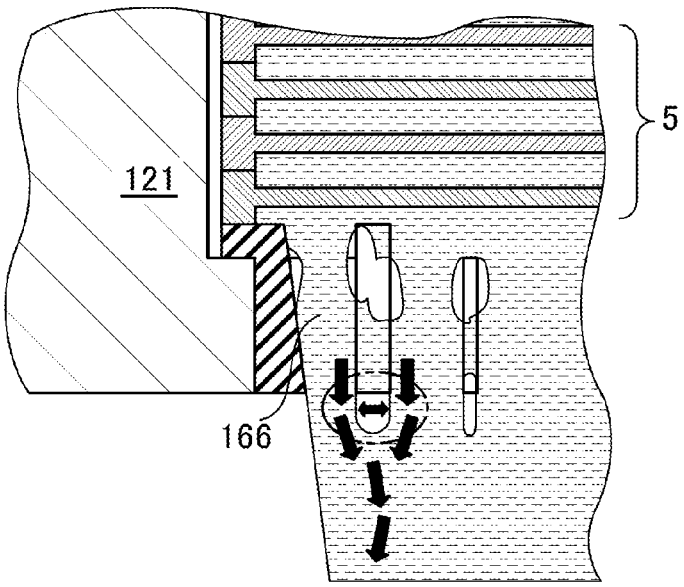
FIG. 21 is a schematic longitudinal section view for explaining a tapered shape (frusto-conical shape) of the annular guiding space.

In addition, in the present embodiment, as shown in FIG. 21, at least an area on a downstream-end side of the annular guiding space 166 has a tapered shape (frusto-conical shape) toward a downstream end thereof. Thus, it is possible to effectively reduce the possibility that the split of the spouted water is caused by the thickness at the most downstream end of the portion of the exposed flow-guiding member 106 defining the inside periphery of the annular guiding space 166. (The water that has flown through the slit portion tends to approach a centerline, which inhibits the split of the spouted water.)

The gap between a downstream-side surface of the second flow-guiding member 5 (the guiding net 51 on the most downstream side) and an upstream-side surface of the exposed flow-guiding member 106 is so small that the exposed flow-guiding member 106 can contact with the second flow-guiding member 5 when the exposed flow-guiding member 106 is elastically deformed. That is to say, the exposed flow-guiding member 106 and the second flow-guiding member 5 are provided close to each other. Thus, when the exposed flow-guiding member 106 is manually deformed for a maintenance operation thereof, the second flow-guiding member 5 can be also deformed through the deformation of the exposed flow-guiding member 106. That is to say, a maintenance operation for the second flow-guiding member 5 can be carried out at the same time. Alternatively, as described above, the exposed flow-guiding member 106 may be made of a non-elastic material.

The other structure of the present embodiment is substantially the same as that of the spout apparatus 1 explained with reference to FIGS. 1 to 9. In FIGS. 13 to 22, the same parts as those of the spout apparatus 1 are shown by the same reference numerals, and detailed explanation thereof is omitted.

Next, an operation of the present embodiment is explained hereinafter.

According to the present embodiment as well, the water supplied from the water channel 3 collides with the shielding portion 43 of the first flow-guiding member 4 (or with the water that has reversed after colliding with the shielding portion 43) so that the water temporarily stays in the first stay chamber 41. Thereby, a water pressure is maintained in the first stay chamber 41. Thereafter, the water that has stayed in the first stay chamber 41 is pushed out by the water supplied from the upstream side, so that the water flows downstream through the through-holes 44 and the through-holes 45.

The water flown out through the through-holes 44 and the through-holes 45 is divided into a water stream that goes straight through the second flow-guiding member 5 toward the spout 102, and another water stream that goes toward a center of the second stay chamber 42 because of some surface tension and/or some negative pressure generated in the second stay chamber 42. The latter water stream is gathered in the center, and then flows out through the second flow-guiding member 5 toward the spout 102.

When the water flows through the four guiding nets 51 of the second flow-guiding member 5, velocity vector of the water is aligned in the water-flow direction. Thereafter, the aligned water streams are spouted out from the spout 102 through the annular guiding space 166 in the outer-periphery area of the exposed flow-guiding member 106 and through the plurality of tubular hollow spaces 165 in the portion of the exposed flow-guiding member 106 inner than the annular guiding space 166. As a result, the water spouted from the spout 102 is unified into one water stream. When the present embodiment is used as an overhead shower, the one water stream lands on the human body and forms a water film along the human body, which can envelop the entire human body. Thus, if the water stream consists of a hot water stream, a deep body temperature of the human body can be effectively increased.

In particular, since the annular guiding space 166 is formed in the outer-periphery area on the spout side of the exposed flow-guiding member 106, generation of a split of the spouted water can be remarkably prohibited, so that extremely high guiding characteristics can be achieved.

In addition, according to the present embodiment, the annular guiding space 166 is ring-shaped in plan view, and the length b of the annular guiding space 166 in the water-flow direction is greater than the width a of the annular guiding space 166 in the radial direction at the downstream end thereof (see FIG. 19A). Thus, even if the water stream contracts after entering the annular guiding space 166, the water stream is guided by the annular guiding space 166 sufficiently enough to be the annular stream without any split, so that the entire guiding characteristics can be maintained.

In addition, according to the present embodiment, the thickness c at the most downstream end of the portion of the exposed flow-guiding member 106 defining the inside periphery of the annular guiding space 166 is not more than the width a of the annular guiding space 166 as seen in the direction of the thickness c (see FIG. 20A). Thus, it is possible to maintain a relatively large amount of the water spouted through the annular guiding space 166, which can achieve a film-like (cylindrical) water stream of the spouted water. The film-like water stream draws the spouted water, so that the entire shape of the water stream spouted from the spout 102 can be maintained. That is to say, the guiding characteristics can be further improved.

In addition, according to the present embodiment, at least the area on the downstream-end side of the annular guiding space 166 has the tapered shape (frusto-conical shape) toward the downstream end of the spout 102 (see FIG. 21). Thus, it is possible to effectively reduce the possibility that the split of the spouted water is caused by the thickness at the most downstream end of the portion of the exposed flow-guiding member 106 defining the inside periphery of the annular guiding space 166.

In addition, since the exposed flow-guiding member 106 is made of an elastic material, the exposed flow-guiding member 106 can be manually pressed and deformed by a user, so that calcium precipitated thereon can be easily removed therefrom. That is to say, the maintenance operation for the exposed flow-guiding member 106 can be easily carried out.

In particular, according to the present embodiment, the portion of the exposed flow-guiding member 106 inner than the annular guiding space 166 is fixed to the portion of the exposed flow-guiding member 106 defining the outside periphery of the annular guiding space 166 and the spout forming member 21 via the seven discrete bridges 162 as if it is floated. Therefore, the portion of the exposed flow-guiding member 106 inner than the annular guiding space 166 is sufficiently deformable when a user presses it.

Furthermore, according to the present embodiment, the exposed flow-guiding member 106 and the second flow-guiding member 5 are provided in contiguity with each other. Thus, when the exposed flow-guiding member 106 is manually deformed for the maintenance operation thereof, the second flow-guiding member 5 can be also deformed through the deformation of the exposed flow-guiding member 106. That is to say, the maintenance operation for the second flow-guiding member 5 can be carried out at the same time. Alternatively, as described above, the exposed flow-guiding member 106 may be made of a non-elastic material.

In addition, according to the present embodiment, the portion of the exposed flow-guiding member 106 defining the inside periphery of the annular guiding space 166 and the portion of the exposed flow-guiding member 106 defining the outside periphery of the annular guiding space 166 are fixed to each other via seven discrete bridges 162 arranged in the circumferential direction at substantially regular intervals, at the area opposite to the spout 102. Thus, the annular guiding space 166 is effectively formed.

Furthermore, according to the present embodiment as well, the water-flow direction is uniformly aligned through the first flow-guiding member 4 and the second flow-guiding member 5, so that the velocity vector is effectively aligned. In addition, the guiding characteristics can be further improved by making each guiding net 51 thicker and/or by making the mesh of each guiding net 51 finer.

Figure 22:
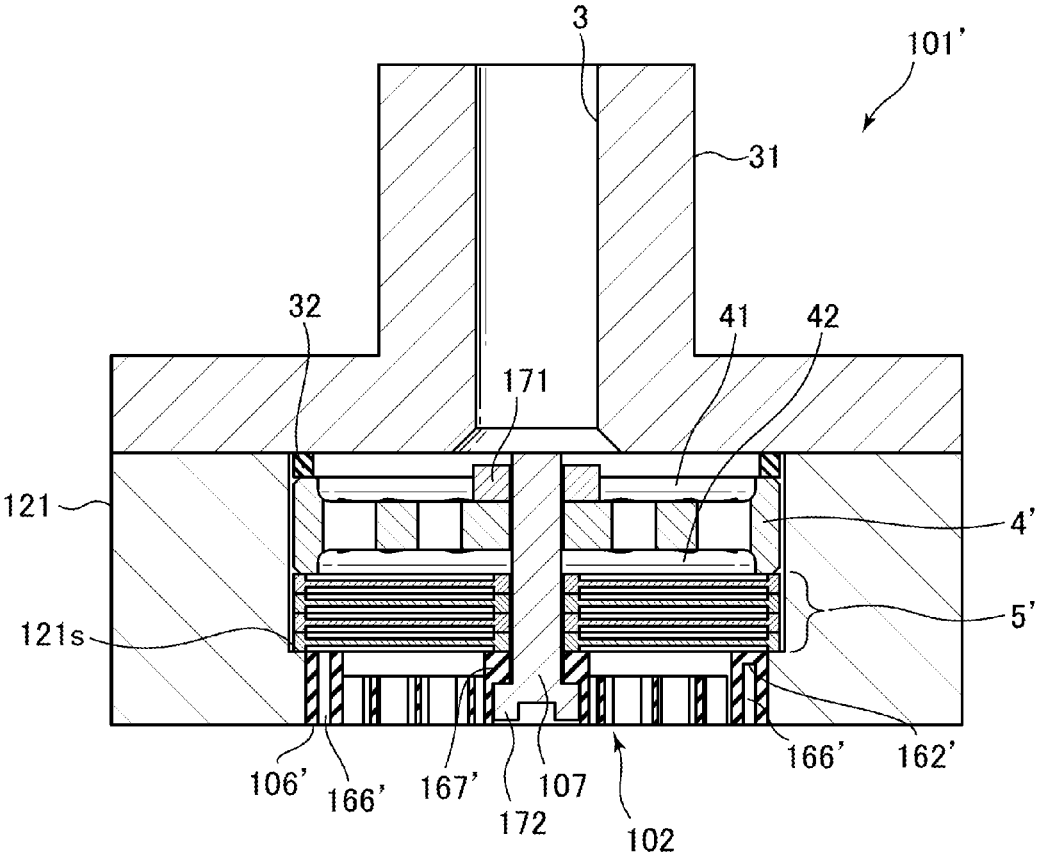
FIG. 22 is a schematic longitudinal section view of a spout apparatus according to further another embodiment of the present invention.
Figure 23:
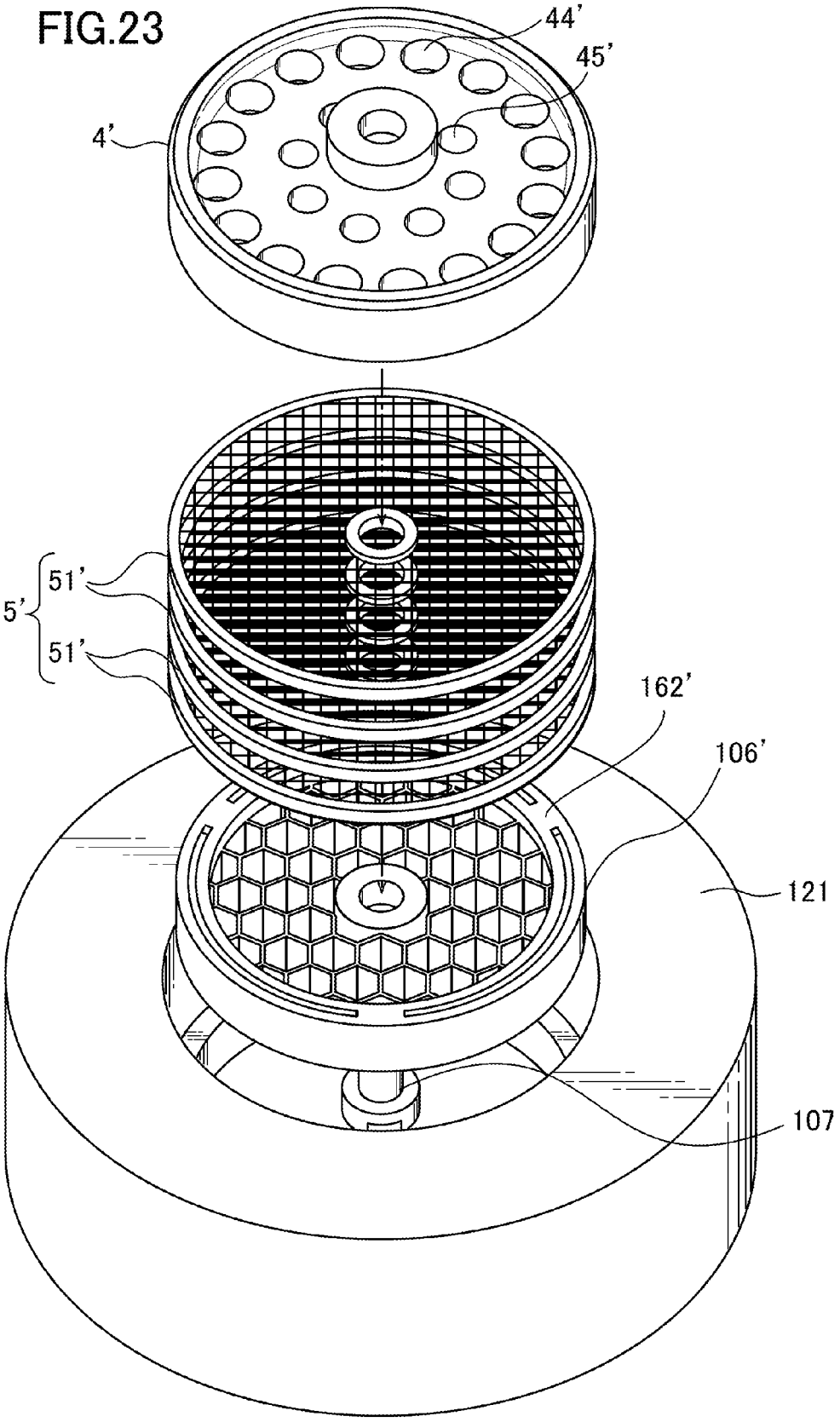
FIG. 23 is an exploded perspective view of a main part of the spout apparatus of FIG. 22.
Figure 24:
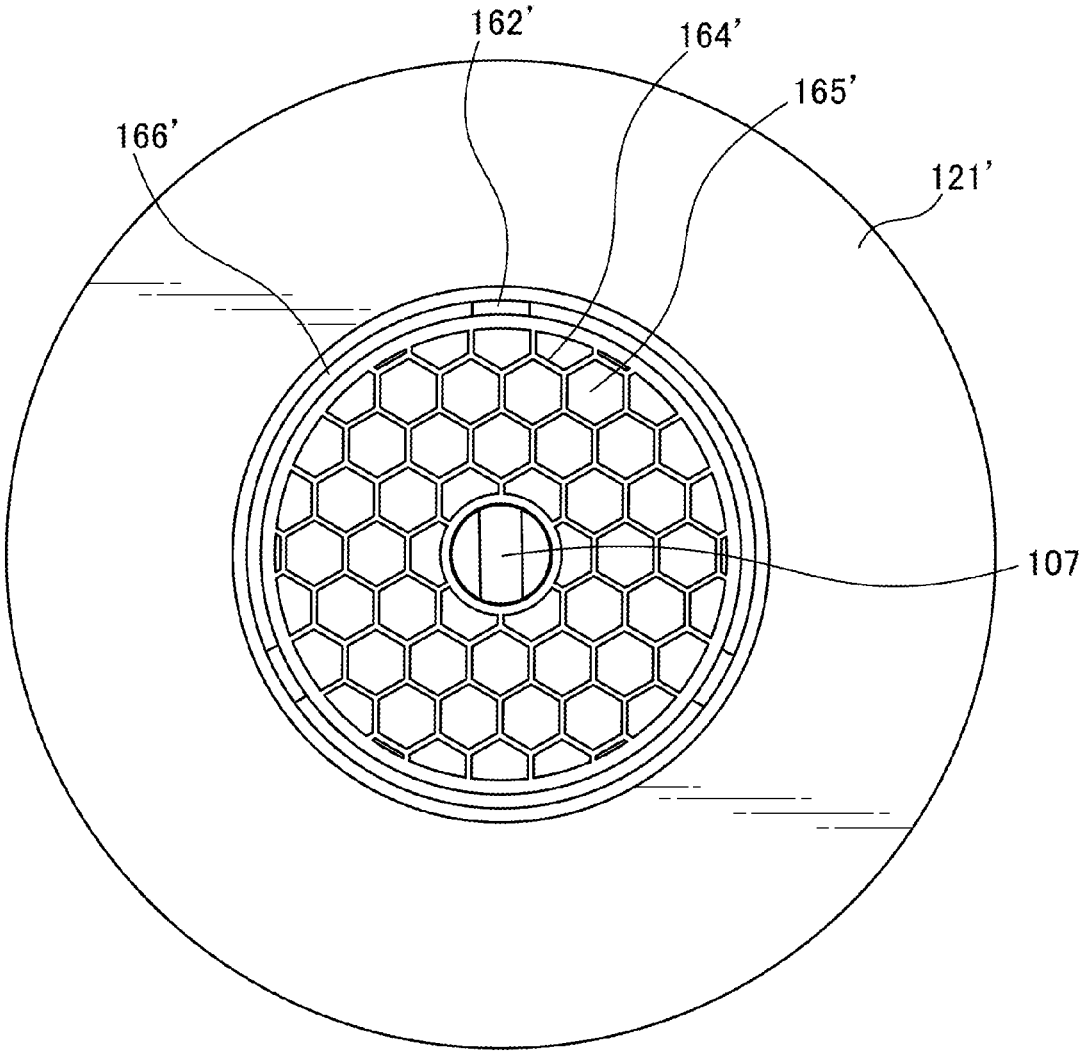
FIG. 24 is a bottom view of the spout apparatus of FIG. 22.
Figure 25A:
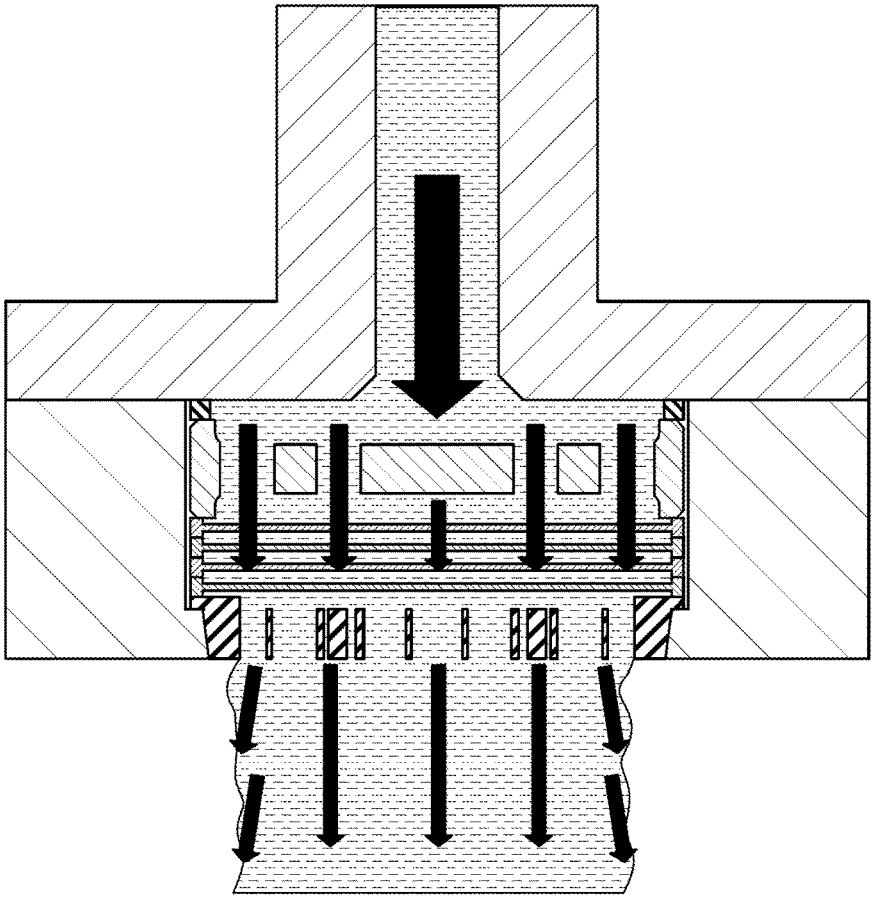
FIGS. 25A and 25B are explanatory views for a split of spouted water when a plurality of bridges is provided at a downstream end of an exposed flow-guiding member.
Figure 25B:
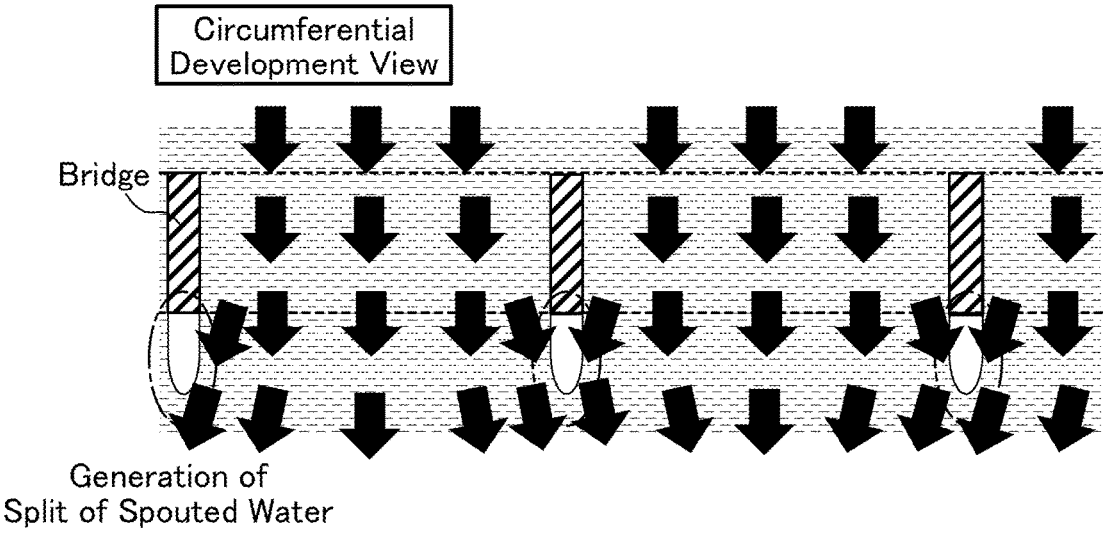

Next, FIG. 22 is a schematic longitudinal section view of a spout apparatus according to further another embodiment of the present invention, FIG. 23 is an exploded perspective view of a main part of the spout apparatus of FIG. 22, and FIG. 24 is a bottom view of the spout apparatus of FIG. 22.

As shown in FIGS. 22 to 24, in the spout apparatus 101' of the present embodiment, differently from the previous embodiment explained with reference to FIGS. 13 to 21, a first flow-guiding member 4', a second flow-guiding member 5' (guiding nets 51') and an exposed flow-guiding member 106' are respectively ring-shaped, and a fixing part (central column) 107 extends through them. The fixing part 107 is supported by the first flow-guiding member 4' via a holding ring 171.

In particular, as shown in FIG. 22, the exposed flow-guiding member 106' of the present embodiment has a central diameter-reduced part 167', and does not have any ring-shaped flange 163. The central diameter-reduced part 167' is supported by a diameter-increased part 172 of the fixing part 107. That is to say, the exposed flow-guiding member 106' is fixed to the spout forming member 121 via the fixing part 107 and the first flow-guiding member 104'. The second flow-guiding member 5 (guiding nets 51) are placed on the shoulder portion 121*s* of the spout forming member 121.

In addition, a plurality of tubular hollow spaces 165' of the exposed flow-guiding member 106' forms a so-called "honeycomb pattern" in plan view (see FIG. 24). In addition, a portion of the exposed flow-guiding member 106' defining an inside periphery of an annular guiding space 166' and another portion of the exposed flow-guiding member 106' defining an outside periphery of the annular guiding space 166' are fixed to each other via three discrete bridges 162' arranged in a circumferential direction at substantially regular intervals, at an area opposite to the spout 102.

In addition, in the present embodiment, a thickness c at an most downstream end of the portion of the exposed flow-guiding member 106 defining the inside periphery of the annular guiding space 166' is substantially the same as a width a of the annular guiding space 166' as seen in the direction of the thickness c. In addition, in the present embodiment, the annular guiding space 166' is cylindrical, i.e., does not have any tapered shape toward the downstream end of the spout 102.

The other structure of the present embodiment is substantially the same as that of the spout apparatus 101 explained with reference to FIGS. 13 to 21. In FIGS. 22 to 24, the same parts as those of the spout apparatus 101 are shown by the same reference numerals, and detailed explanation thereof is omitted.

According to the present embodiment as well, the water spouted from the spout 102 is unified into one water stream. When the present embodiment is used as an overhead shower, the one water stream lands on the human body and forms a water film along the human body, which can envelop the entire human body. Thus, if the water stream consists of a hot water stream, a deep body temperature of the human body can be effectively increased.

In particular, according to the present embodiment, the annular guiding space 166' is formed in the outer-periphery area of the exposed flow-guiding member 106' made of an elastic material. Thus, generation of a split of the spouted water can be remarkably prohibited, so that extremely high guiding characteristics can be achieved.

In addition, according to the present embodiment as well, the annular guiding space 166' is ring-shaped in plan view, and the length b of the annular guiding space 166' in the water-flow direction is greater than the width a of the annular guiding space 166' in the radial direction at the downstream end thereof (see FIG. 19A). Thus, even if the water stream contracts after entering the annular guiding space 166', the water stream is guided by the annular guiding space 166' sufficiently enough to be the annular stream without any split, so that the entire guiding characteristics can be maintained.

In addition, since the exposed flow-guiding member 106' is made of an elastic material, the exposed flow-guiding member 106' can be manually pressed and deformed by a user, so that calcium precipitated thereon can be easily removed therefrom. That is to say, the maintenance operation for the exposed flow-guiding member 106' can be easily carried out.

In particular, according to the present embodiment, the portion of the exposed flow-guiding member 106' inner than the annular guiding space 166' is fixed to the portion of the exposed flow-guiding member 106' defining the outside periphery of the annular guiding space 166' and the spout forming member 121 via the three discrete bridges 162' as if it is floated. Therefore, the portion of the exposed flow-guiding member 106' inner than the annular guiding space 166' is sufficiently deformable when a user presses it.

Furthermore, according to the present embodiment, the exposed flow-guiding member 106' and the second flow-guiding member 5' are provided in contiguity with each other. Thus, when the exposed flow-guiding member 106' is manually deformed for the maintenance operation thereof, the second flow-guiding member 5' can be also deformed through the deformation of the exposed flow-guiding member 106'. That is to say, the maintenance operation for the second flow-guiding member 5' can be carried out at the same time. Alternatively, as described above, the exposed flow-guiding member 106' may be made of a non-elastic material.

EXPLANATION OF SIGN

1, 1' spout apparatus
2 spout
21 spout forming member
3 water channel
31 water channel forming member
32 ring-shaped seal
4, 4' first flow-guiding member
41 first stay chamber
42 second stay chamber
43 shielding portion
44, 44' through-hole
45, 45' through-hole
5, 5' second flow-guiding member
51, 51' guiding net
6, 6' exposed flow-guiding member
61, 61' outside-periphery guiding surface
62 bridge
63 ring-shaped flange
64, 64' baffle
65, 65' hollow space
66, 66' annular guiding space
67' central diameter-reduced part
7 fixing part
71 holding ring
72 diameter-increased part
101, 101' spout apparatus
102 spout
121 spout forming member
106, 106' exposed flow-guiding member
162, 162' bridge
163 ring-shaped flange
164, 164' baffle
165, 165' hollow space
166, 166' annular guiding space
167' central diameter-reduced part
107 fixing part
171 holding ring
172 diameter-increased part

What is claimed is:

1. A spout apparatus comprising:

a spout forming member configured to form a spout, a flow-guiding member provided inside the spout forming member, configured to guide water on an upstream side of the spout, an exposed flow-guiding member having a plurality of hollow spaces provided inside the spout forming member and on a spout side of the flow-guiding member, and exposed on a spout side of the exposed flow-guiding member, and a water channel forming member configured to form a water channel, the water channel configured to supply the water to an upstream side of the flow-guiding member, wherein:

the exposed flow-guiding member and the spout forming member are configured to spout water from an outer periphery as a flow-guided annular stream and from said plurality of hollow spaces, among the water spouted from the spout, the exposed flow-guiding member has an outer-periphery guiding surface at an area on the spout side of the exposed flow-guiding member, the outer-periphery guiding surface has an annular shape, a continuous annular guiding space is formed between the outer-periphery guiding surface and the spout forming member to form the flow-guided annular stream and is configured to spout the water as the flow-guided annular stream, and a length of the continuous annular guiding space in a water-flow direction is greater than a width of the continuous annular guiding space in a radial direction at a lower end thereof.

2. The spout apparatus according to claim 1, wherein the continuous annular guiding space has a cylindrical shape.

3. The spout apparatus according to claim 1, wherein the plurality of hollow spaces are tubular and separated by a baffle extending in a water-flow direction, and wherein the baffle has a latticed pattern in plan view.

4. The spout apparatus according to claim 3, wherein a thickness of a wall at a most downstream end of the baffle located at an outermost area of the exposed flow-guiding member is not more than a width of the continuous annular guiding space in a direction of the thickness.

5. The spout apparatus according to claim 1, wherein at least an area on a downstream-end side of an inside surface of the spout has a tapered shape toward a downstream end of the spout.

6. The spout apparatus according to claim 1, wherein the exposed flow-guiding member is fixed to the spout forming member via a plurality of discrete bridges at an area opposite to the spout.

7. The spout apparatus according to claim 1, wherein the exposed flow-guiding member is made of an elastic member.

8. The spout apparatus according to claim 1, wherein the exposed flow-guiding member is made of a member which is harder to be deformed than the flow-guiding member.

9. The spout apparatus according to claim 1, wherein the exposed flow-guiding member and the flow-guiding member are provided in contiguity with each other.

10. A spout apparatus comprising:

a spout forming member configured to form a spout, a flow-guiding member provided inside the spout forming member, configured to guide water on an upstream side of the spout, an exposed flow-guiding member having a plurality of hollow spaces provided inside the spout forming member and on a spout side of the flow-guiding member, and exposed on a spout side of the exposed flow-guiding member, the exposed flow-guiding member being configured to spout water from said plurality of hollow spaces, and a water channel forming member configured to form a water channel, the water channel configured to supply the water to an upstream side of the flow-guiding member, wherein:

the exposed flow-guiding member has a continuous annular guiding space at an outer peripheral area on the spout side of the exposed flow-guiding member, the continuous annular guiding space is configured to spout water as a flow-guided annular stream, among the water spouted from the spout, and a length of the continuous annular guiding space in a water-flow direction is greater than a width of the continuous annular guiding space in a radial direction at a lower end thereof.

11. The spout apparatus according to claim 10, wherein the continuous annular guiding space has a cylindrical shape.

12. The spout apparatus according to claim 10, wherein the plurality of hollow spaces are tubular and separated by a baffle extending in a water-flow direction, on an inner side of the continuous annular guiding space, and wherein the baffle has a latticed pattern in plan view.

13. The spout apparatus according to claim 12, wherein a thickness of a wall at a most downstream end of the baffle defining an inner periphery of the continuous annular guiding space is not more than a width of the continuous annular guiding space in a direction of the thickness.

14. The spout apparatus according to claim 10, wherein at least an area on a downstream-end side of the continuous annular guiding space has a tapered shape toward a downstream end of the continuous annular guiding space.

15. The spout apparatus according to claim 10, wherein a part of the exposed flow-guiding member defining an outer periphery of the continuous annular guiding space is fixed to a part of the exposed flow-guiding member defining an inner periphery of the continuous annular guiding space via a plurality of discrete bridges at an area opposite to the spout.

16. The spout apparatus according to claim 10, wherein the exposed flow-guiding member and the flow-guiding member are provided in contiguity with each other.

* * * * *